US009231348B2

(12) United States Patent
Kanemura

(10) Patent No.: US 9,231,348 B2
(45) Date of Patent: Jan. 5, 2016

(54) WATERPROOF CONNECTOR

(71) Applicant: Sumitomo Wiring Systems, Ltd., Yokkaichi, Mie (JP)

(72) Inventor: Keisuke Kanemura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/534,369

(22) Filed: Nov. 6, 2014

(65) Prior Publication Data

US 2015/0140847 A1 May 21, 2015

(30) Foreign Application Priority Data

Nov. 19, 2013 (JP) ..... 2013-238645

(51) Int. Cl.

| | |
|---|---|
| ***H01R 13/64*** | (2006.01) |
| ***H01R 13/645*** | (2006.01) |
| ***H01R 13/629*** | (2006.01) |
| *H01R 13/52* | (2006.01) |
| *H01R 13/436* | (2006.01) |
| *H01R 13/703* | (2006.01) |
| *H01R 107/00* | (2006.01) |

(52) U.S. Cl.

CPC ..... *H01R 13/645* (2013.01); *H01R 13/4368* (2013.01); *H01R 13/62938* (2013.01); *H01R 13/4362* (2013.01); *H01R 13/5208* (2013.01); *H01R 13/5219* (2013.01); *H01R 13/7032* (2013.01); *H01R 2107/00* (2013.01)

(58) Field of Classification Search

CPC ..... H01R 13/645

See application file for complete search history.

(56) References Cited

U.S. PATENT DOCUMENTS

| | | | | |
|---|---|---|---|---|
| 6,171,140 | B1 * | 1/2001 | Anbo | H01R 13/7032 439/516 |
| 2005/0176295 | A1 * | 8/2005 | Morita | H01R 13/645 439/587 |
| 2015/0140847 | A1 * | 5/2015 | Kanemura | H01R 13/4368 439/259 |

FOREIGN PATENT DOCUMENTS

| | | |
|---|---|---|
| JP | 10-012317 | 1/1998 |

* cited by examiner

*Primary Examiner* — James Harvey

(74) *Attorney, Agent, or Firm* — Gerald E. Hespos; Michael J. Porco; Matthew T. Hespos

(57) ABSTRACT

A waterproof connector includes a housing (20) that accommodates terminal fittings (12). A rubber plug (40) is fit in the housing (20) and a rear holder (50) is mounted behind the rubber plug (40). The rear holder (50) is set in a partially locked state while inserting the terminal fittings (12) and is set in a fully locked state after the terminal fittings (12) are accommodated completely. A lever (80) is assembled with the housing (20) and is moved to assist a connection to a mating connector (90). Movement limiting portions (70) are retracted from a movable range of the lever (80) to permit movement of the lever (80) when the rear holder (50) is in the fully locked state, but are in the movable range of the lever (80) to limit movement of the lever (80) when the rear holder (50) is in the partially locked state.

4 Claims, 22 Drawing Sheets

WATERPROOF CONNECTOR

BACKGROUND

1. Field of the Invention

The invention relates to a waterproof connector.

2. Description of the Related Art

A conventional waterproof connector has a housing for accommodating a terminal fitting, a rubber plug fit on a rear of the housing to seal the interior of the housing and a rear holder mounted behind the rubber plug. The rear holder is set in a partially locked state when inserting the terminal fitting into the housing, but is set in a fully locked state when the terminal fitting is inserted completely.

Japanese Unexamined Patent Publication No. H10-12317 discloses a waterproof connector with a rear holder that is configured so that a fixed plate and an intermediate plate are connected by a hinge. The fixed plate and the intermediate plate are formed with an insertion hole that communicates with a through hole of a rubber plug when the rear holder is in the partially locked state. The fixed plate further has a wire clamping hole with a smaller diameter than the insertion hole and communicating with the insertion hole.

The rear holder of the waterproof connector shown in Japanese Unexamined Patent Publication No. H10-12317 is set in the fully locked state by pushing down the fixed plate after the rear holder is in the partially locked state and the terminal fitting is inserted into the insertion holes. The wire clamping hole on the fixed plate moves to overlap a center of the insertion hole when the rear holder is moved from the partially locked state to the fully locked state. Thus, the wire is press-fit into the wire clamping hole and enters a state where a movement of the wire is restricted. Accordingly, a clearance between the rubber plug and the wire due to a displacement of the wire will not be formed, with the result that sealing can be improved.

The waterproof connector described above exhibits a high sealing performance by setting the rear holder in the fully locked state. Thus, it is important to reliably set the fully locked state without forgetting a transition to the fully locked state after the rear holder is set in the partially locked state and the wire is completely accommodated.

The invention was completed based on the above situation and aims to provide a waterproof connector capable of reliably setting a rear holder in a fully locked state.

SUMMARY OF THE INVENTION

The invention is directed to a waterproof connector with a housing in which a terminal fitting fixed to an end of a wire is accommodated. A rubber plug is fit in a rear end of the housing to seal the interior of the housing. A rear holder is mounted behind the rubber plug. The rear holder is set in a partially locked state when inserting the terminal fitting into the housing and is set in a fully locked state when the terminal fitting is inserted completely. A lever is assembled with the housing and can be moved to assist a connecting operation to a mating connector. A movement limiting portion on the rear holder is retracted from a movable range of the lever when the rear holder is in the fully locked state to permit a movement of the lever, but is in the movable range of the lever to limit the movement of the lever when the rear holder is in the partially locked state. Accordingly, movement of the lever is limited if a transition of the rear holder to the fully locked state is forgotten, thereby indicating that the rear holder is in the partially locked state. Thus, the rear holder can be set reliably in the fully locked state.

The rear holder may not project from the rear end of the housing when in the fully locked state and may project from the rear end of the housing when in the partially locked state. Thus, whether the rear holder is in the fully locked state or in the partially locked state can be easily visually distinguished. Thus, the rear holder can be more reliably set in the fully locked state.

The rubber plug may be formed with an insertion hole that enables the terminal fitting to be inserted into the housing. A recess that is recessed forward may be formed at a side of the insertion hole in the rubber plug. The rear holder may include a projection to be fit into the recess as the rear holder transitions from the partially locked state to the fully locked state. The projection may press the insertion hole in a diameter reducing direction by being fit into the recess in a manner to resiliently push and widen the recess. Accordingly, when the rear holder is set in the fully locked state after the terminal fitting is inserted into the insertion hole of the rubber plug, the insertion hole is pressed in the diameter reducing direction to enhance adhesion between the rubber plug and the wire. Thus, a high sealing performance can be ensured without deteriorating operability when inserting the terminal fitting into the insertion hole of the rubber plug.

The rear holder may include a full locking portion to be locked to the housing when a transition is made from the partially locked state to the fully locked state. The full locking portion may contact the housing to be resiliently deflected during the transition and may be restored resiliently to be locked to the housing when the rear holder is set in the fully locked state. Thus, a force required for a transition of the rear holder from the partially locked state to the fully locked state can be reduced as compared with the case where the full locking portion on the rear holder is locked to the housing such as by press-fitting. As a result, the rear holder can easily transition to the fully locked state.

According to the invention, it is possible to provide a waterproof connector capable of reliably setting a rear holder in a fully locked state.

DETAILED DESCRIPTION

Figure 1:
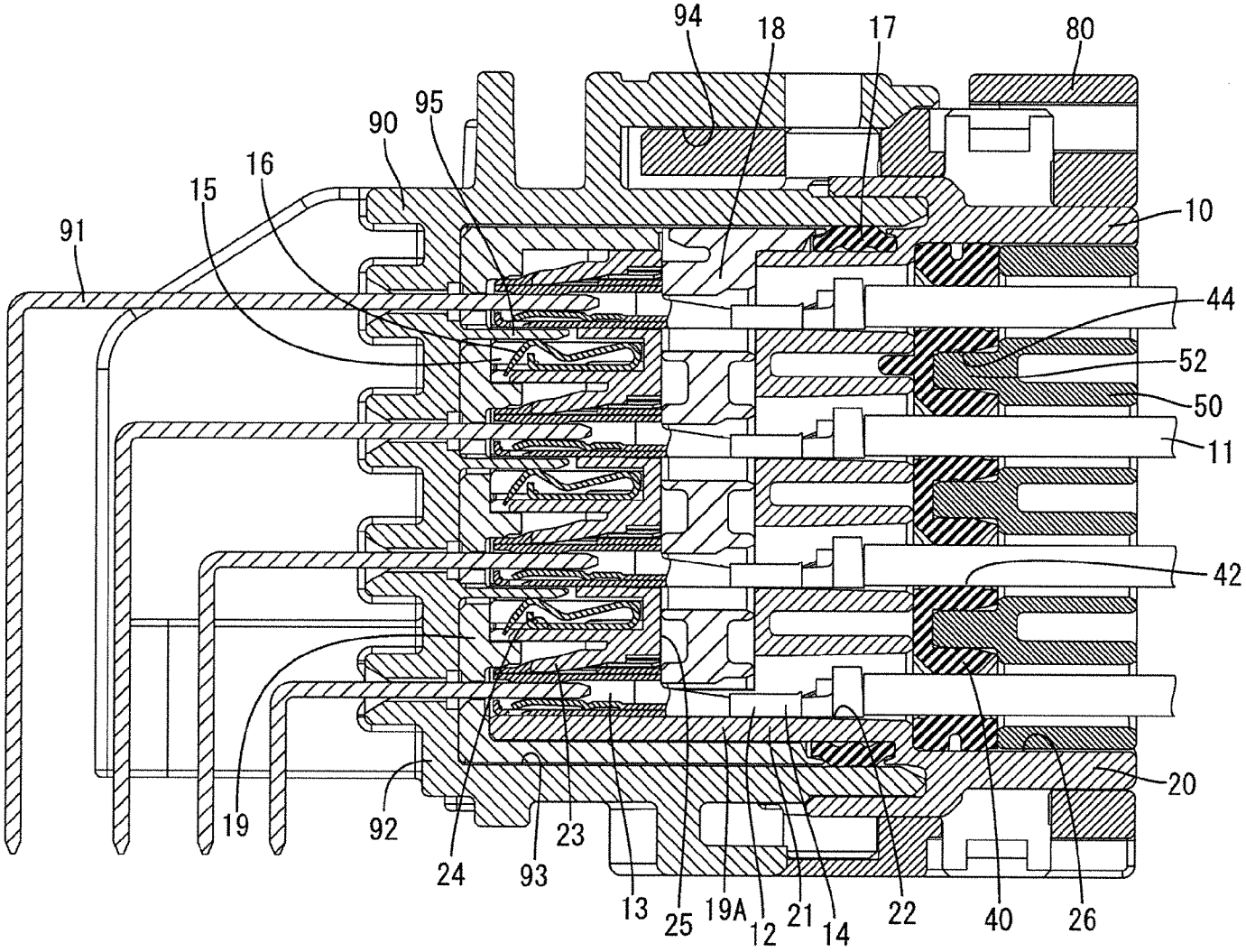
FIG. 1 is a section showing a properly connected state of a connector of an embodiment of the invention and a mating connector.

A connector in accordance with an embodiment of the invention is identified by the numeral 10 in FIGS. 1 to 22. The connector 10 is a waterproof connector including a housing 20 for accommodating terminal fittings 12 fixed to ends of wires 11. A one-piece rubber plug 40 is fit in a rear end of the housing 20 to seal the interior of the housing 20 and a rear holder 50 is mounted behind the one-piece rubber plug 40. The connector 10 includes a lever 80 that can be rotated to assist connecting and separating operations to and from a mating connector 90. In the following description, an end to be connected to a mating member and an opposite end are referred to as a front end and a rear end for each constituent member and upper and lower sides of FIG. 1 are referred to as upper and lower sides.

As shown in FIG. 1, the mating connector 90 includes male type terminal fittings (hereinafter, referred to as mating terminal fittings 91) and a housing for holding the mating terminal fittings 91 (hereinafter, referred to as a mating housing 92), and the mating housing 92 includes a plurality of connector fitting portions 93 into each of which the connector 10 is individually fittable. Further, a lever accommodating portion 94 in which the lever 80 is accommodated when the two connectors 10, 90 are connected is provided above each connector fitting portion 93. Note that the mating connector 90 is such a board connector that the mating terminal fittings 91 extending from the mating housing 92 are to be connected to an unillustrated board.

The connector 10 is formed by assembling the lever 80 with the housing 20 capable of holding the terminal fittings 12.

Figure 2:
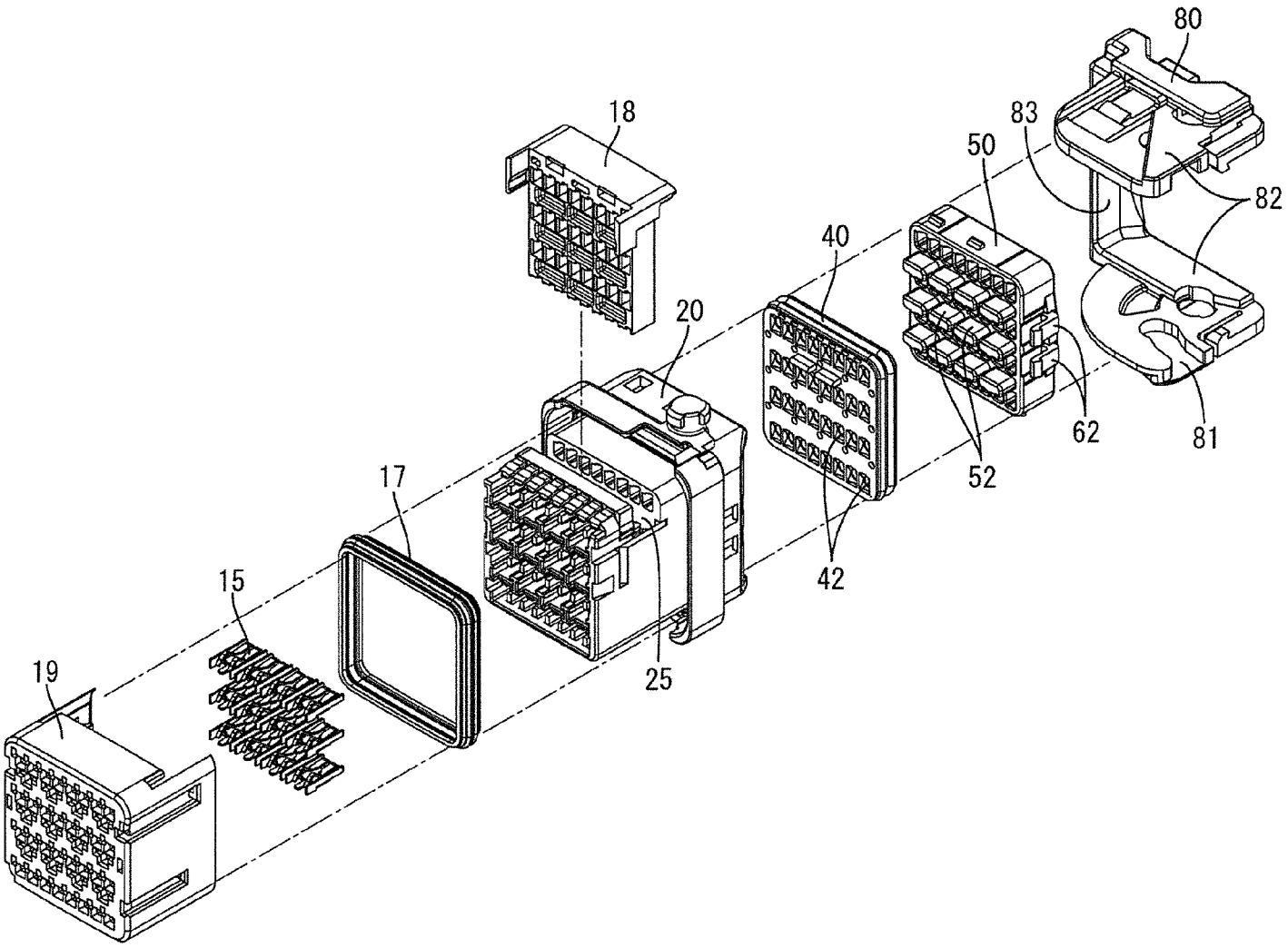
FIG. 2 is an exploded perspective view showing the connector.

The lever 80 is mounted rotatably on the housing 20. The lever 80 is substantially U-shaped has two cam plates 82 formed with cam grooves 81 and an operating portion 83 coupling the cam plates 82, as shown in FIG. 2.

When the lever 80 is set at an initial position (see FIG. 16) and the two connectors 10, 90 are lightly connected, cam pins (not shown) of the mating connector 90 are introduced into the entrances of the cam grooves 81. When the lever 80 is rotated from the initial position toward a connection position (see FIG. 17), the cam pins move along the cam grooves 81 and the two connectors 10, 90 are pulled toward each other by a cam action based on the engagement of the cam pins and the cam grooves. When the lever 80 eventually reaches the connection position, the two connectors 10, 90 reach a properly connected state.

Figure 3:
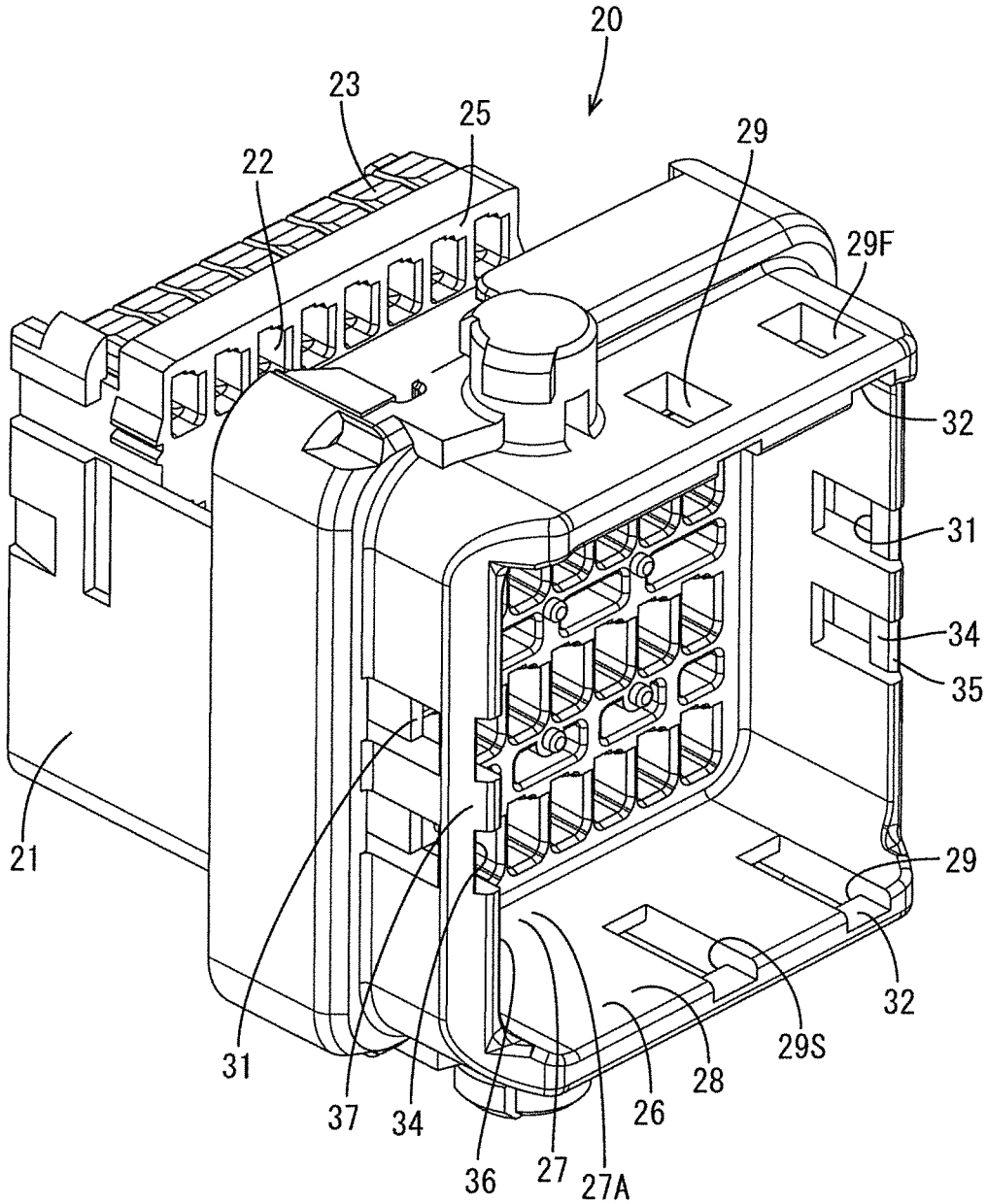
FIG. 3 is a perspective view of a housing when viewed from behind.

The housing 20 is made of synthetic resin and, as shown in FIG. 3, in the form of a substantially rectangular block as a whole, and a front part thereof serves as a terminal accommodating portion 21 capable of accommodating a plurality of female terminal fittings 12 and a plurality of shorting terminals 15 (see FIG. 1) inside.

As shown in FIG. 1, the terminal fitting 12 is connected to an end of a wire 11 and is formed, such as by press-working an electrically conducive metal plate, to have a long narrow shape. A rectangular tubular connecting portion 13 is at a front half of the terminal fitting 12 and a mating terminal fitting 91 is inserted therein from the front to be connected from front. A barrel 14 is formed at the rear of the terminal fitting 12 and can be crimped to the end of the wire 11.

The shorting terminal 15 is formed by press-working an electrically conductive metal plate and includes two resilient contact pieces 16 that can resiliently contact the terminal fittings 12.

Cavities 22 are provided in the terminal accommodating portion 21 for accommodating the terminal fittings 12 crimped to the ends of the wires 11. The cavities 22 are formed in each of four vertically arranged stages. A resin locking lance 23 is provided in each cavity 22 for primarily locking and retaining the terminal fitting 12 inserted into the cavity 22.

Shorting terminal accommodating chambers 24 also are provided in the terminal accommodating portion 21 for accommodating the shorting terminals 15. The shorting terminal accommodating chambers 24 are located between the cavities 22 in a vertical direction. The shorting terminal 15 accommodated in the shorting terminal accommodating chamber 24 shorts the terminal fittings 12 inserted into two cavities 22 provided above the shorting terminal accommodating chamber 24.

Resilient contact pieces 16 are provided on the shorting terminal 15 and are in contact with the terminal fittings 12 to short the terminal fittings 12 when the connector 10 is not connected to the mating connector 90. A short releasing portion 95 is provided in the mating connector 90 and enters between the terminal fittings 12 and the resilient contact pieces 16 to release a shorted state of the terminal fittings 12 when the connector 10 is connected properly to the mating connector 90.

A retainer inserting portion 25 into which a retainer 18 is to be inserted is provided substantially in a central part of the terminal accommodating portion 21 in the front-back direction. The retainer 18 is held at a partial locking position for permitting forward movements of the terminal fittings 12 as the terminal fittings 12 are inserted, and can be pushed to a full locking position to secondarily lock and retain the terminal fittings 12 after the terminal fittings 12 are inserted.

A substantially rectangular seal ring 17 is fit on the outer peripheral surface of the terminal accommodating portion 21. In the properly connected state of the mating connector 90 and the connector 10, the seal ring 17 is sandwiched between the outer peripheral surface of the housing 20 and the inner peripheral surface of the connector fitting portion 93 to hold the interior of the connector fitting portion 93 in a sealed state.

A front holder 19 is mounted on the front surface of the terminal accommodating portion 21 and is made of a synthetic resin material. In a state where the front holder 19 is mounted on the housing 20, the rear end of a peripheral wall portion 19A faces the front end of the seal ring 17 to prevent the seal ring 17 from coming off forward.

An accommodating portion 26 is open backward behind the terminal accommodating portion 21 in the housing 20 and accommodates the one-piece rubber plug 40 and the rear holder 50 (see FIG. 3). The accommodating portion 26 has a substantially rectangular shape with four arcuate corners when viewed from behind.

A front part of the accommodating portion 26 defines a rubber plug accommodating portion 27 for accommodating the one-piece rubber plug 40 and a rear part defines a holder accommodating portion 28 for accommodating the rear holder 50. The inner peripheral surface of the rubber plug accommodating portion 27 defines a sealing surface 27A to be held in close contact with the one-piece rubber plug 40.

The holder accommodating portion 28 includes partial locked portions 29 to be locked by partial locking portions 54 of the rear holder 50 to be described later and full locked portions 31 to be locked by full locking portions 62.

As shown in FIG. 3, the partial locked portions 29 are a pair of openings penetrating through each of upper and lower walls of the holder accommodating portion 28. Out of the partial locked portions 29, those provided on the upper wall of the holder accommodating portion 28 (hereinafter, referred to as first partial locked portions 29F) have a shorter dimension in the front-back direction than those provided on the lower wall (hereinafter, referred to as second partial locked portions 29S).

Figure 12:
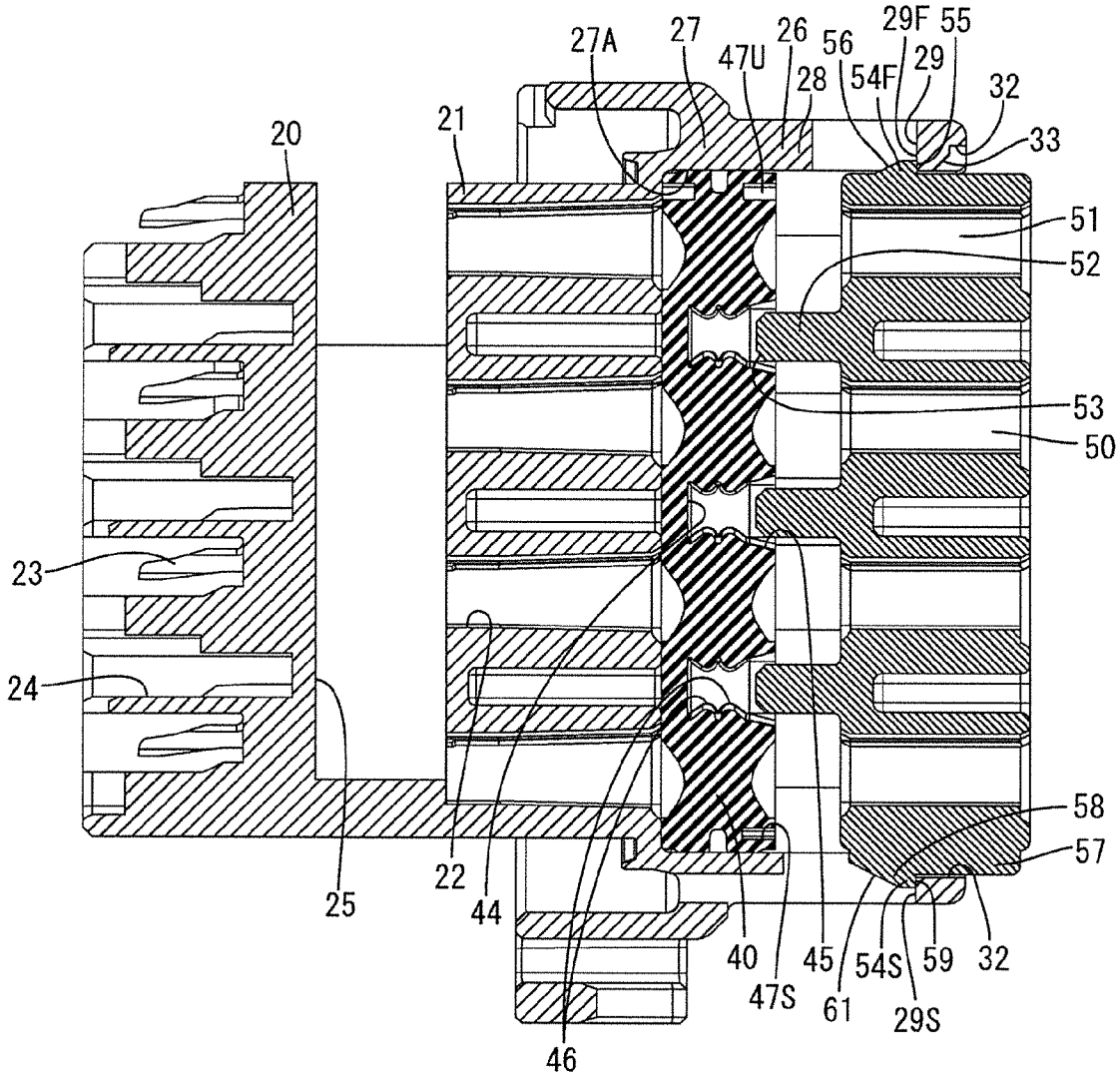
FIG. 12 is a cross-section taken along A-A of FIG. 7, showing the housing with the rear holder in the partially locked state.
Figure 13:
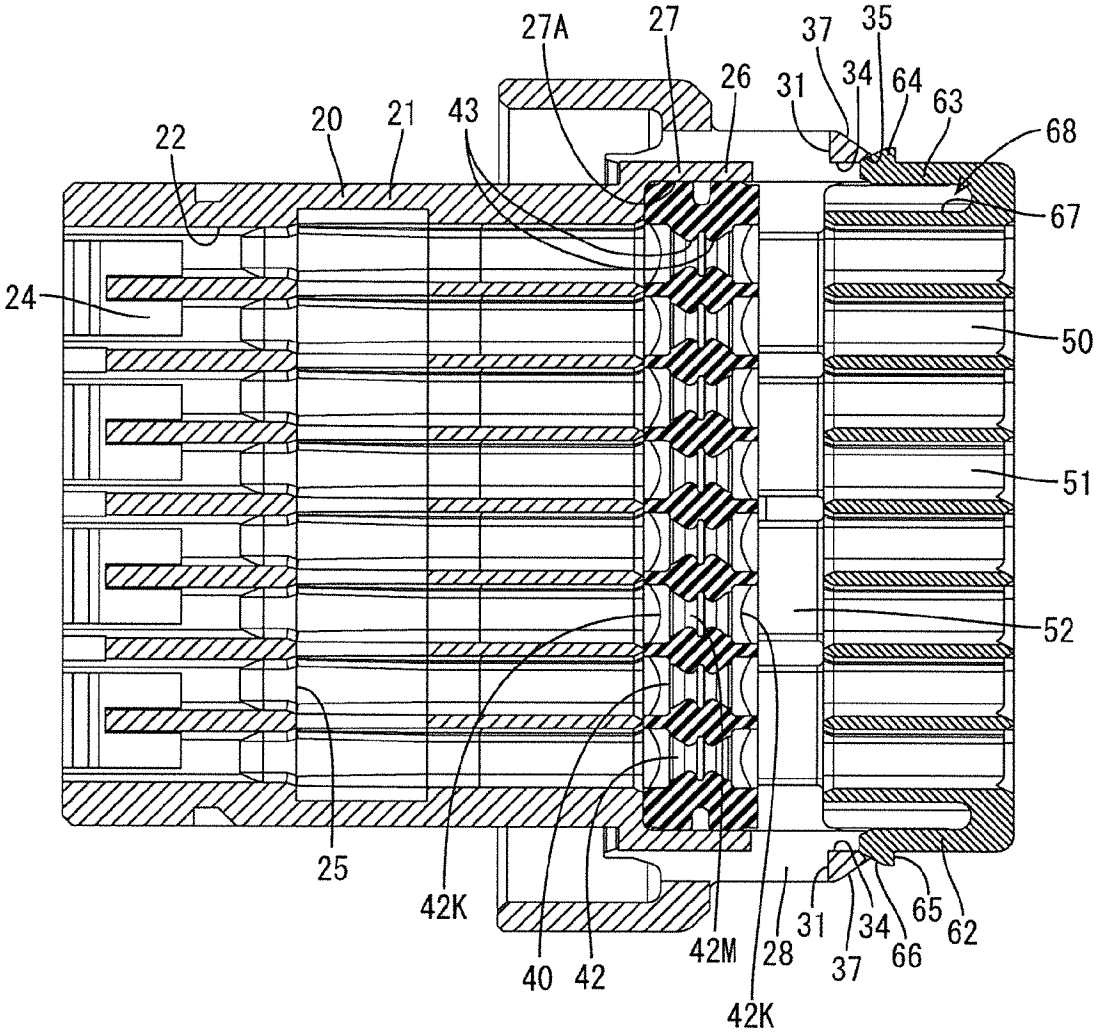
FIG. 13 is a cross-section taken along B-B of FIG. 7, showing the housing with the rear holder in the partially locked state.
Figure 14:
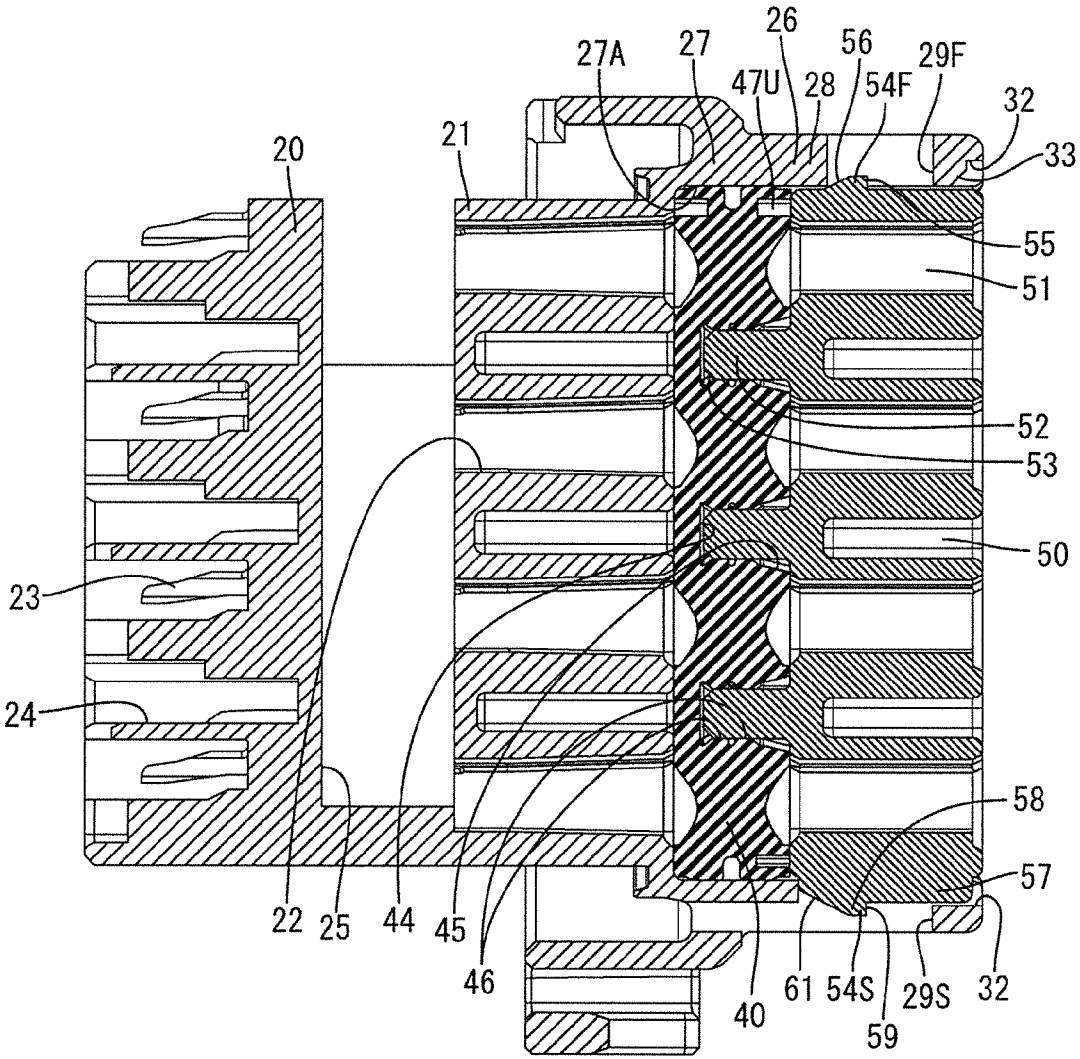
FIG. 14 is a cross-section taken along A-A of FIG. 7, showing the housing with the rear holder in the fully locked state.
Figure 15:
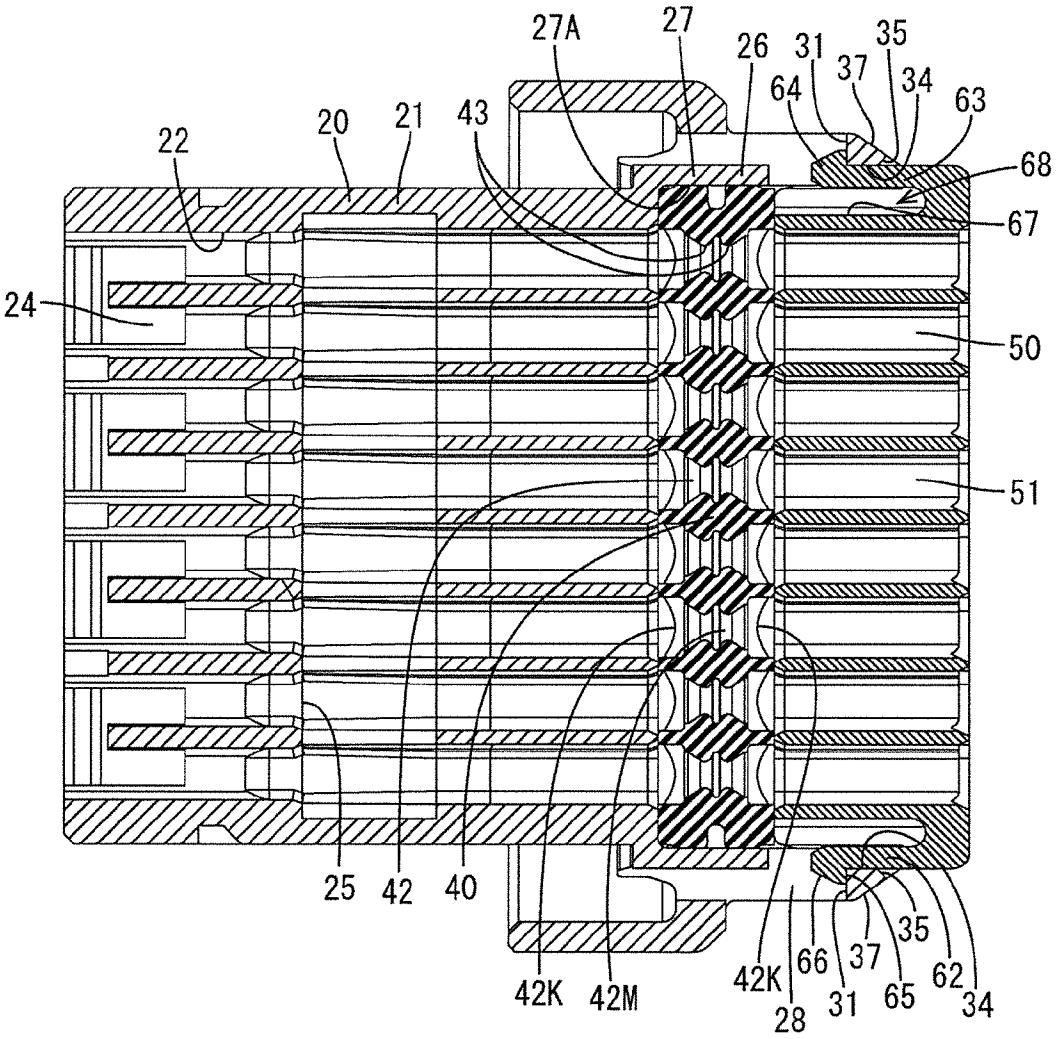
FIG. 15 is a cross-section taken along B-B of FIG. 7, showing the housing with the rear holder in the fully locked state.
Figure 16:
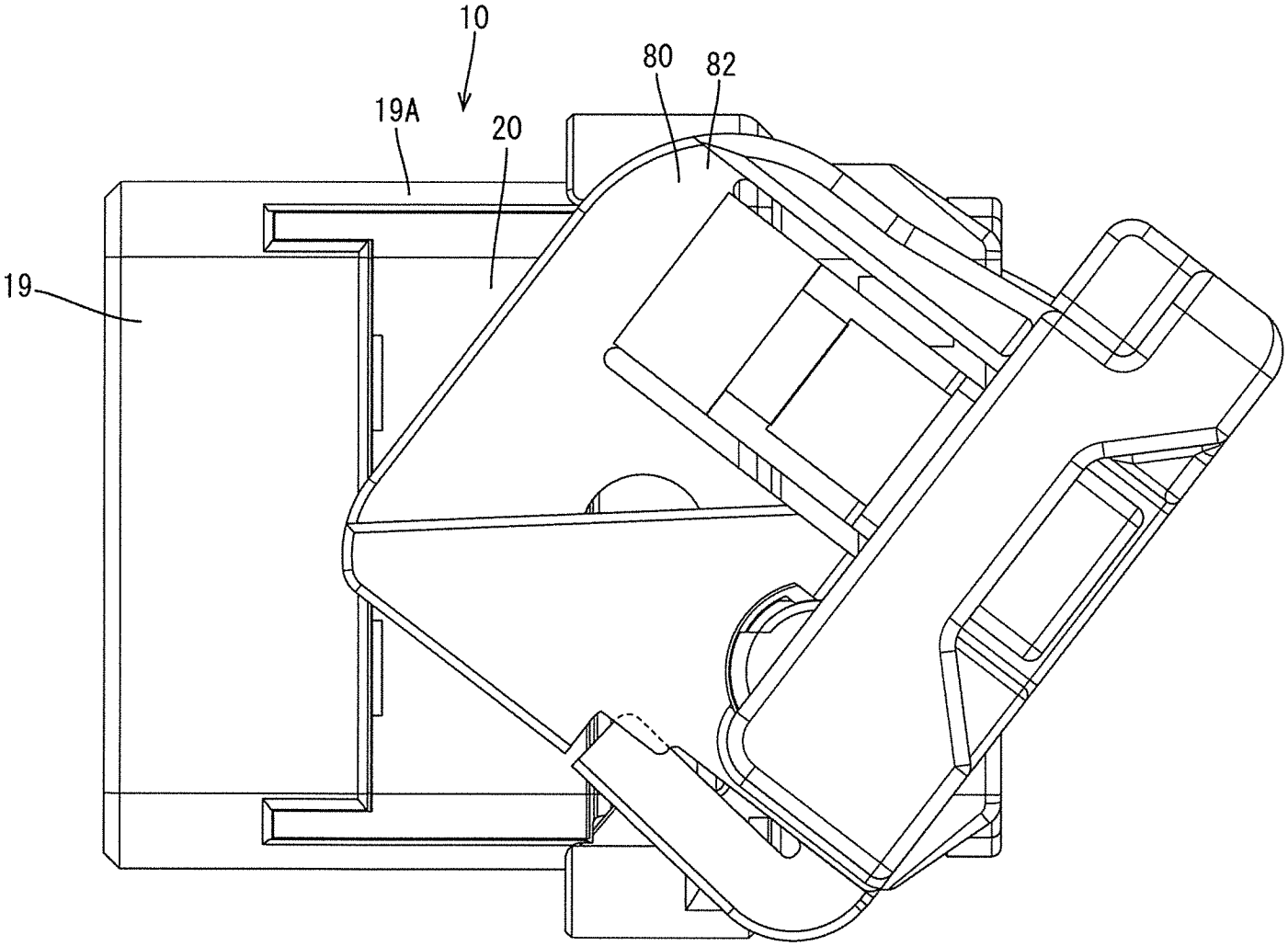
FIG. 16 is a plan view of the connector when a lever is at an initial position.
Figure 17:
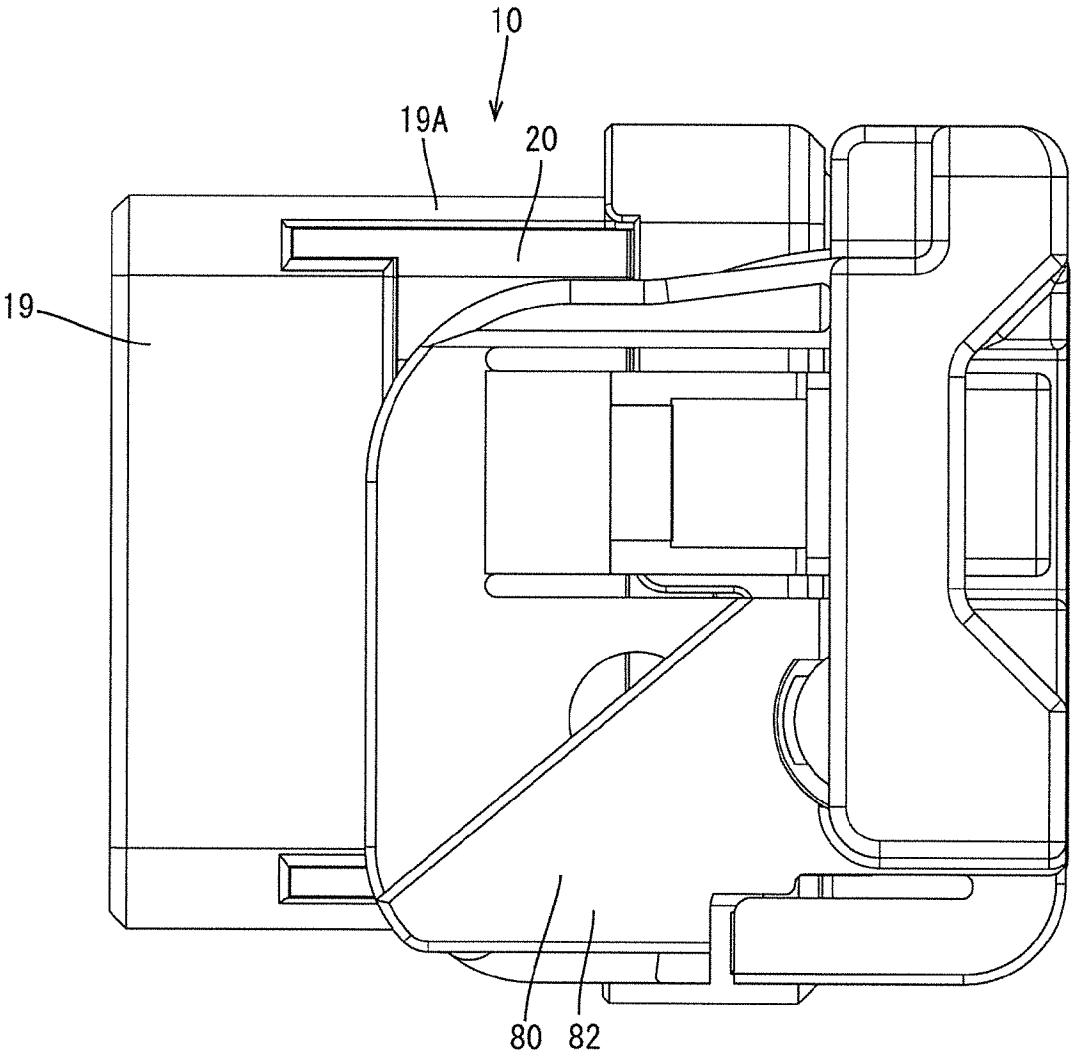
FIG. 17 is a plan view of the connector with the lever at a connection position.
Figure 18:
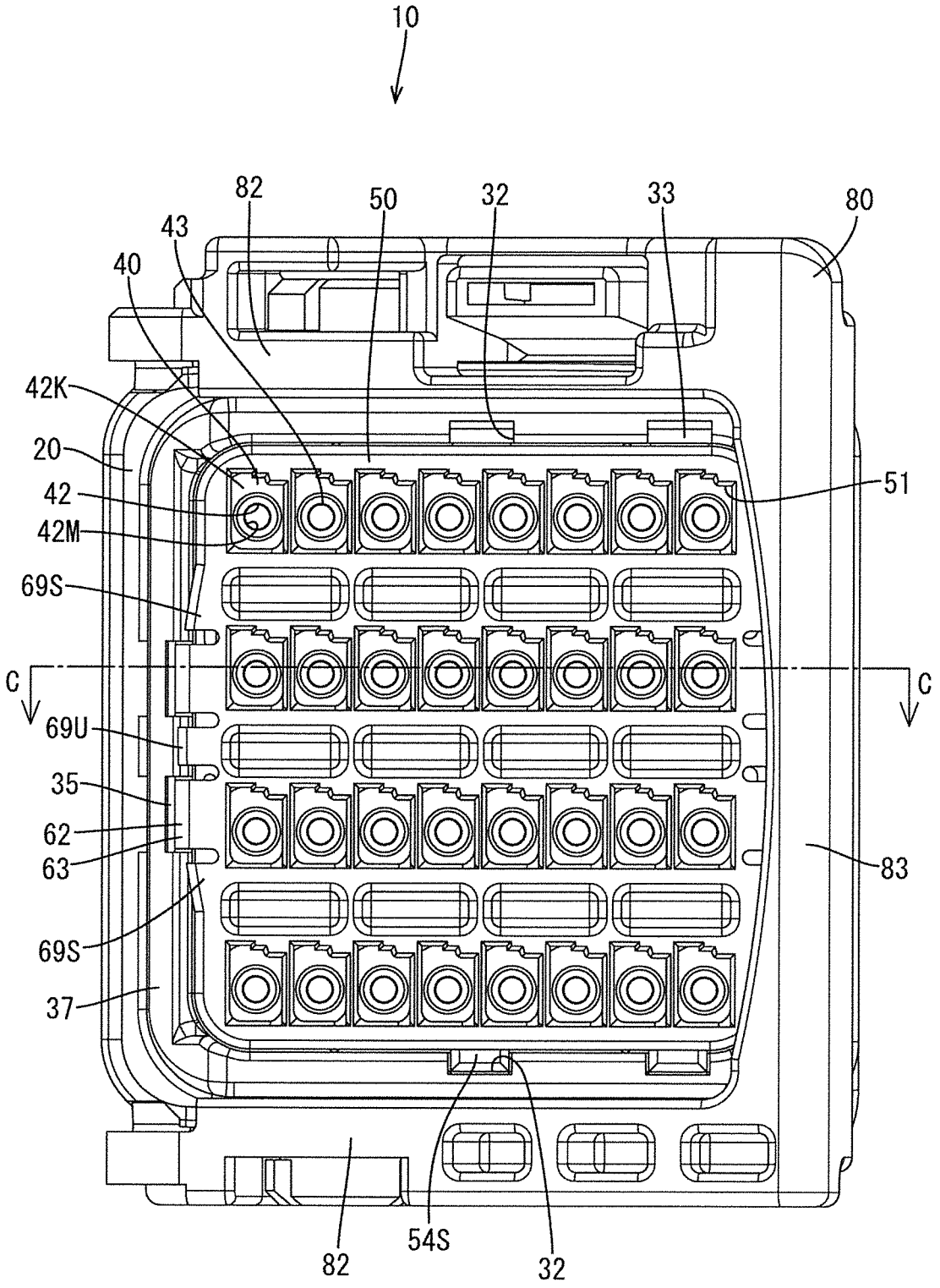
FIG. 18 is a rear view of the connector with the rear holder in the fully locked state.

Parts of the upper and lower walls of the holder accommodating portion 28 behind the first and second partial locked portions 29F, 29S have a smaller wall thickness than other parts, and partial locking recesses 32 are formed on inner peripheral sides thereof. Further, as shown in FIG. 12, tapered surfaces 33 for guiding the partial locking portions 54 of the rear holder 50 are formed on sides behind the first partial locked portions 29F on the rear end of the holder accommodating portion 28.

As shown in FIG. 3, the full locked portions 31 are two openings penetrating each of opposite side walls of the holder accommodating portion 28. Parts of the opposite side walls of the holder accommodating portion 28 behind the full locked portions 31 have thinner walls, and full locking recesses 34 are formed on inner peripheral sides thereof. Further, tapered surfaces 35 for guiding full locking portions 62 of the rear holder 50 are formed on rear end parts of the full locking recesses 34.

Figure 9:
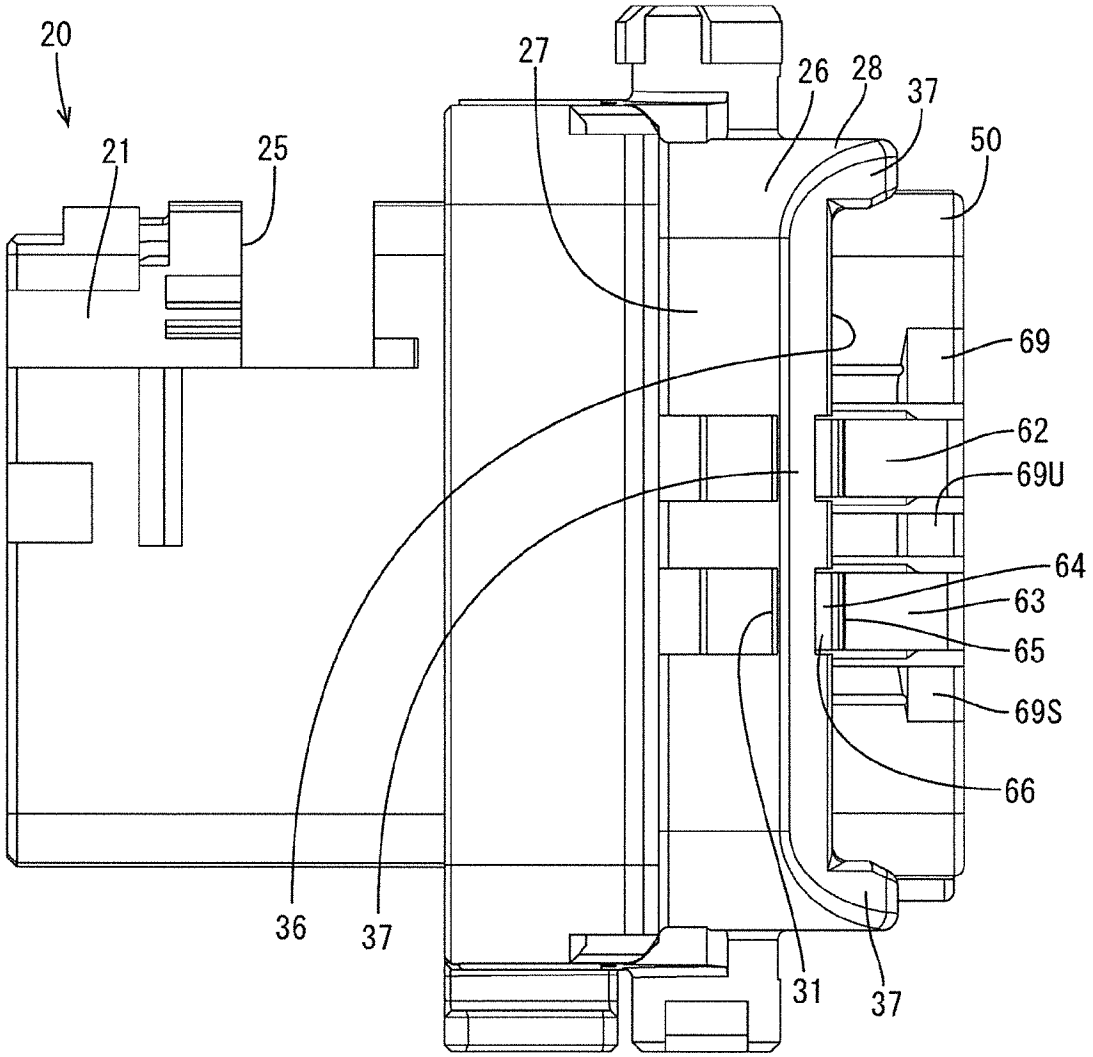
FIG. 9 is a side view of the housing with the rear holder in the partially locked state.

As shown in FIG. 9, cut portions 36 are formed on a rear part of the holder accommodating portion 28 and are recessed slightly forward from other parts. The cut portions 36 are formed on the opposite side walls of the holder accommodating portion 28 and are formed by cutting entire central parts of the side walls by a predetermined width while leaving upper and lower end parts of the side walls.

Figure 8:
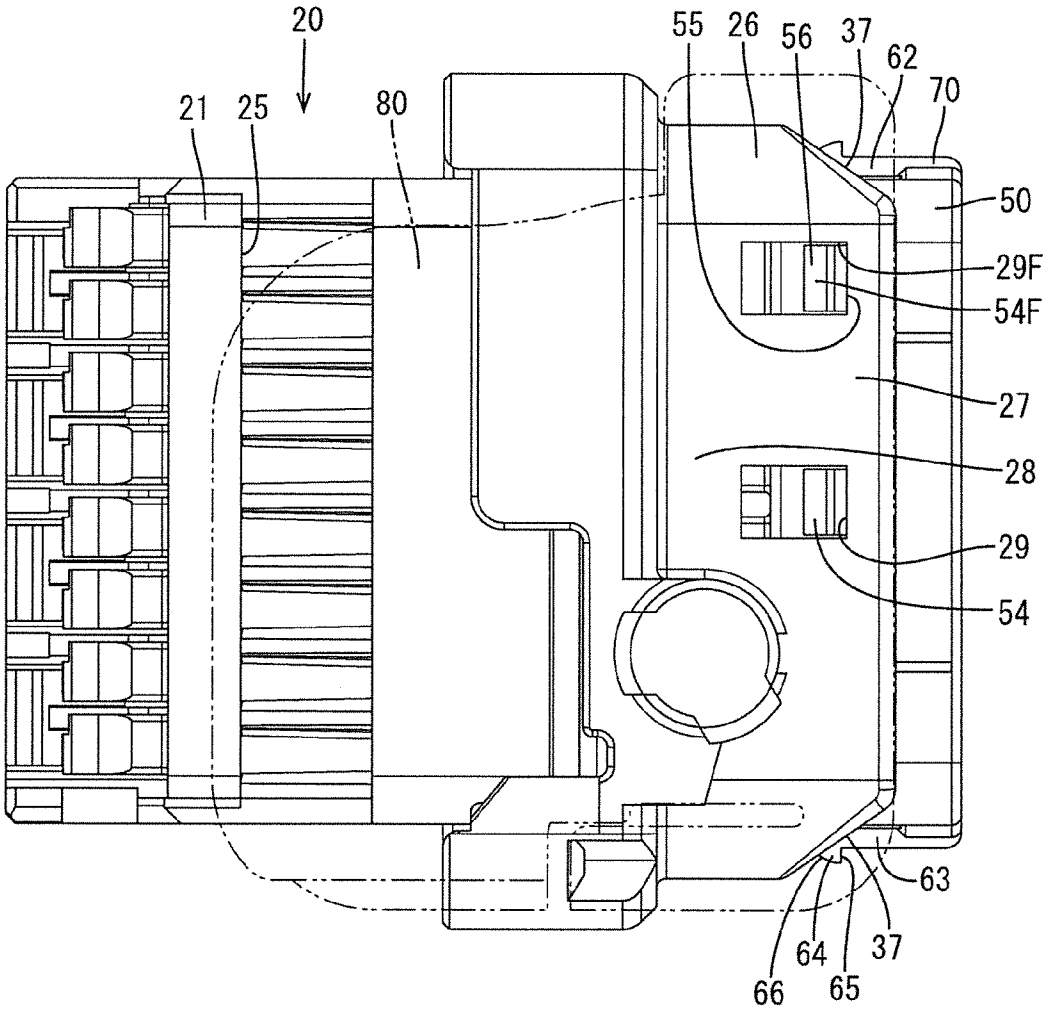
FIG. 8 is a plan view of the housing with the rear holder in the partially locked state.

As shown in FIG. 8, corners of the rear part of the holder accommodating portion 28 are cut obliquely to form chamfers 37. The chamfers 37 are formed from the upper ends to the lower ends of both corners of the rear end part of the holder accommodating portion 28. Note that the chamfers 37 are formed in ranges before the cut portions 36, as shown in FIG. 9.

Figure 4:
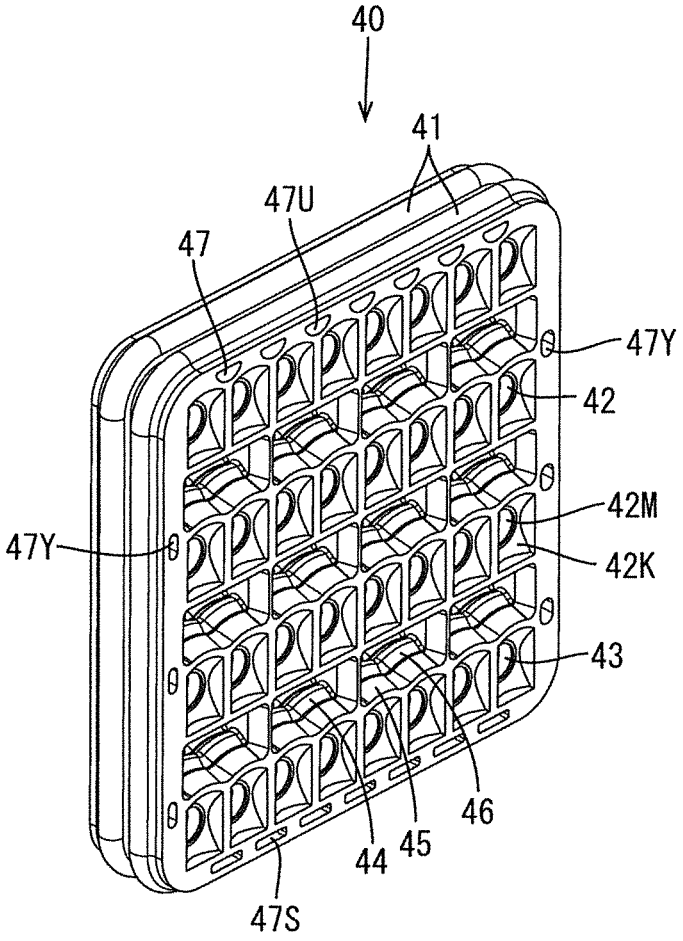
FIG. 4 is a rear perspective view of a one-piece rubber plug.
Figure 5:
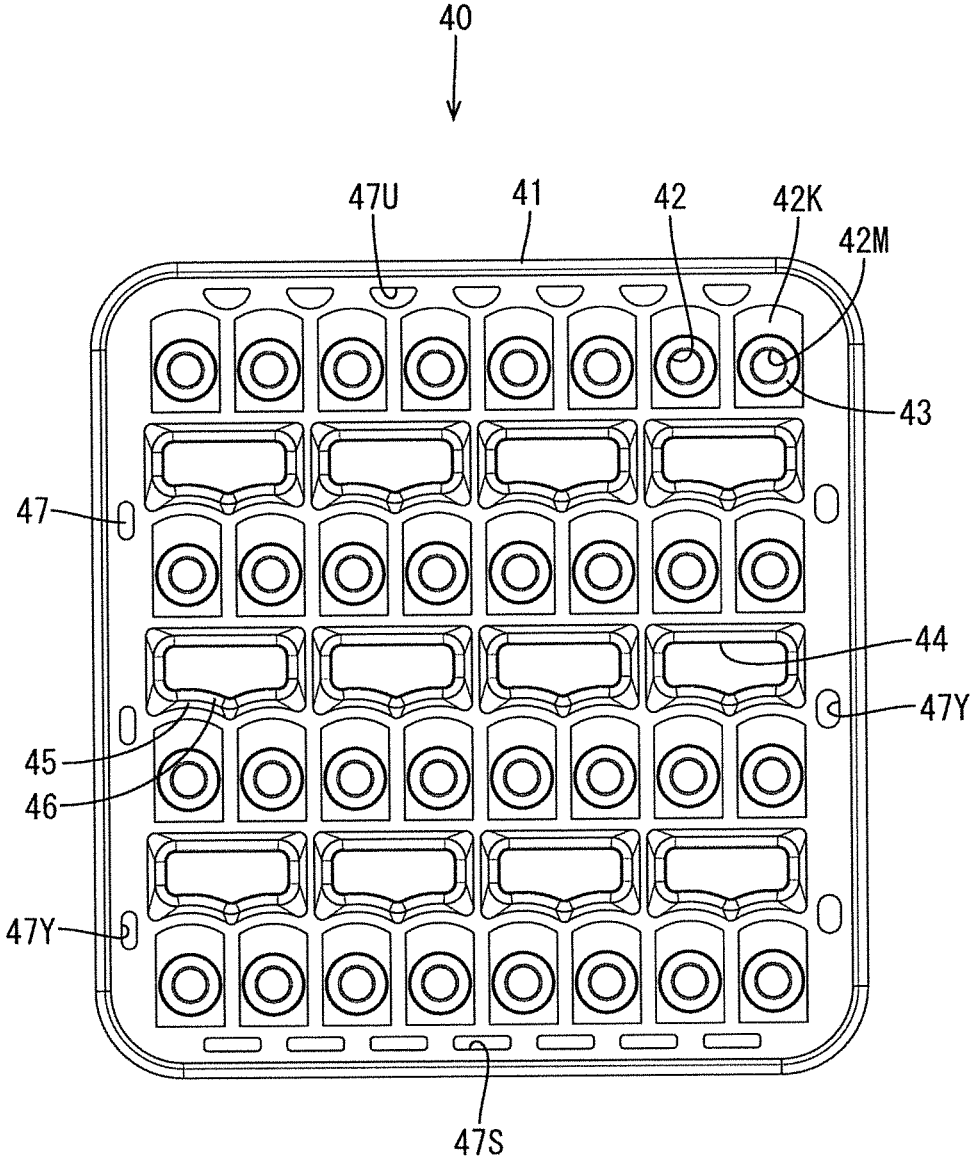
FIG. 5 is a rear view showing the one-piece rubber plug.

As shown in FIGS. 4 and 5, the one-piece rubber plug 40 is a thick substantially rectangular plate tightly fittable into the rubber plug accommodating portion 27. Outer peripheral lips 41 are formed on the outer periphery of the one-piece rubber plug 40 and are held resiliently in close contact with the sealing surface 27A of the rubber plug accommodating portion 27 to keep the outer periphery of the one-piece rubber plug 40 and the sealing surface 27A in a watertight state.

As shown in FIG. 4, insertion holes 42 penetrate through the one-piece rubber plug 40 and enable the terminal fittings 12 to be inserted into the terminal accommodating portion 21. The plurality of insertion holes 42 are formed to correspond to the respective cavities 22.

A central part of each insertion hole 42 in the front-back direction defines a close contact portion 42M with a circular shape that can be held in close contact with the outer peripheral surface of the wire 11. Inner peripheral lips 43 are formed on the inner periphery of the close contact portion 42M and are held resiliently in close contact with the outer periphery of the wire 11 (see FIG. 13).

Expanded portions 42K having a larger vertical opening diameter than the close contact portion 42M are provided before and after the close contact portion 42M of the insertion hole 42. The expanded portion 42K is recessed moderately and arcuately toward a vertical center thereof (see FIG. 4). The expanded portion 42K is made wider at an upper side of the close contact portion 42M in conformity with the shape of the terminal fitting 12. Note that the upper edge of the expanded portion 42K is moderately arcuate and the lower edge thereof is straight.

Forward recesses 44 are formed, as shown in FIG. 5, at sides of the insertion holes 42 on the rear surface of the one-piece rubber plug 40. The recesses 44 are provided between the insertion holes 42 in vertically adjacent stages of the insertion holes 42. Note that all of the recesses 44 have substantially the same shape.

The recesses 44 are closed at the front ends thereof. As shown in FIG. 5, the recess 44 is laterally wide and has a width extending over two insertion holes 42 when viewed from behind. The upper edge of the recess 44 is straight along the lower edges of the expanded portions 42K of the insertion holes 42 located above. Further, the lower edge of the recess 44 is shaped in conformity with the upper edges of the expanded portions 42K of two insertion holes 42 located below, a widthwise center thereof is slightly lowered and opposite sides are moderately arcuate to bulge up. A wall between the recess 44 and the insertion holes 42 is located above and a wall between the recess 44 and the insertion holes 42 below have an equal thickness.

A tapered guiding portion 45 for guiding a projection 52 of the rear holder 50 to be described later is provided on a rear end part of the recess 44. A pair of front and rear pressed lips 46 to be strongly pressed outwardly by the projection 52 are formed on a side of the recess 44 before the guiding portion 45 (see FIG. 12). The pair of pressed lips 46 are located substantially at the same positions as the pair of inner peripheral lips 43 provided in the close contact portion 42M of the insertion hole 42.

As shown in FIG. 5, holes 47 are formed side by side along the outer peripheral edge of the one-piece rubber plug 40 on the rear surface of the one-piece rubber plug 40. The holes 47 are formed along the upper, lower and opposite side edges of the one-piece rubber plug 40, and the shapes thereof differ along each edge. Specifically, upper-edge holes 47U along the upper edge of the one-piece rubber plug 40 have a half-moon shape, lower-edge holes 47S along the lower edge have a long and narrow rectangular shape and side-edge holes 47Y along the opposite side edges have an elliptical shape. Further, the side-edge holes 47Y on one side (left side in FIG. 5) have a smaller width than those arranged on the other side (right side).

The upper-edge and lower-edge holes 47U, 47S are between the insertion holes 42 adjacent in the width direction and the side-edge holes 47Y are between the recesses 44 and the insertion holes 42 located below the recesses 44 in the vertical direction. As shown in FIG. 12, the holes 47 are formed in a part behind the center in the front-back direction without penetrating through the one-piece rubber plug 40.

Figure 6:
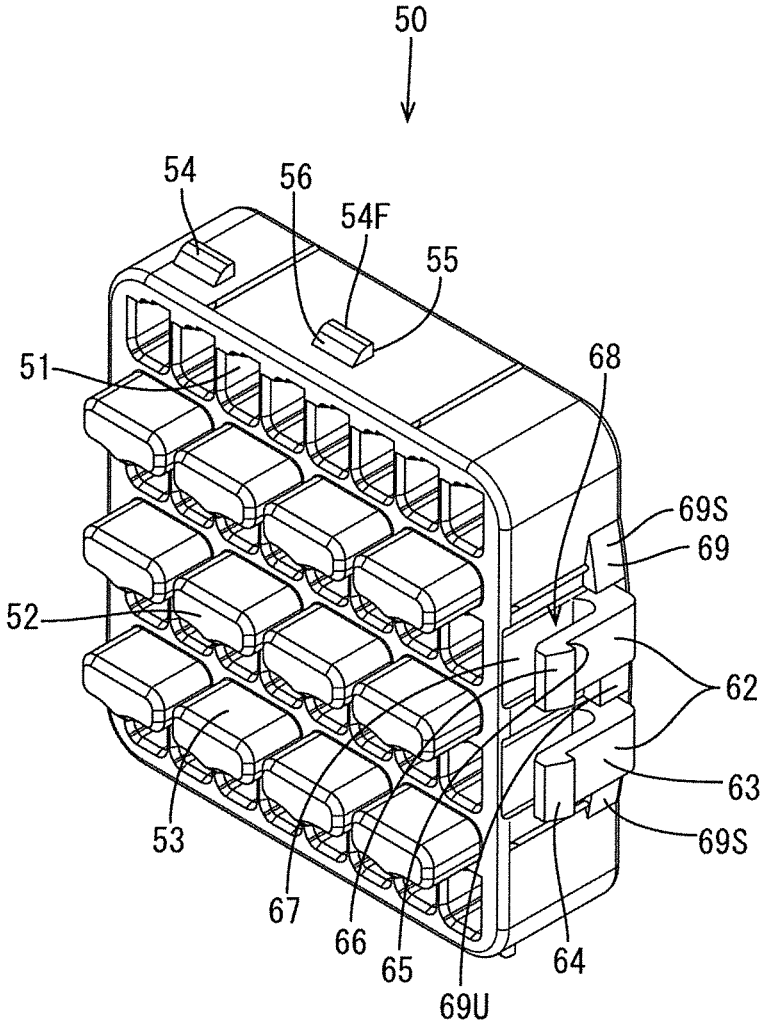
FIG. 6 is a perspective view of a rear holder when viewed from the front.

The rear holder 50 is made of synthetic resin and, as shown in FIG. 6, in the form of a substantially rectangular thick plate as a whole and substantially tightly fittable into the holder accommodating portion 28. The rear holder 50 is set in a partially locked state in accommodating the terminal fittings 12 into the housing 20 while being set in a fully locked state when the terminal fittings 12 are completely accommodated.

Receiving holes 51 penetrate through the rear holder 50 in the front-back direction and the terminal fittings 12 are insertable therethrough. The receiving holes 51 correspond to the insertion holes 42 of the one-piece rubber plug 40 and have substantially the same cross-sectional shape as the cavities 22 in the housing 20.

The rear holder 50 includes the projections 52 to be fit into the recesses 44 of the one-piece rubber plug 40 as the rear holder 50 transitions from the partially locked state to the fully locked state. The projections 52 press the close contact portions 42M of the insertion holes 42 in a diameter reducing direction by being fitted in such a manner as to resiliently push and widen the recesses 44.

The projections 52 project on the front surface of the rear holder 50 and are provided at positions corresponding to all the recesses 44. The projection 52 has an outer shape in conformity with the shape of the recess 44 and is in the form of a column having a wide rectangular cross-section. The upper surface of the projection 52 is a flat surface and the lower surface is formed by arranging two moderately arcuate surfaces in the width direction. A guiding surface 53 is formed on the front end of the projection 52 over the entire outer peripheral edge for smoothly guiding the projection 52 into the recess 44. A rear side of the projection 52 is bored (see FIG. 12).

The rear holder 50 includes the partial locking portions 54 to be locked to the holder accommodating portion 28 in the partially locked state. Two partial locking portions 54 are provided on each of the upper and lower surfaces of the rear holder 50. The partial locking portions 55 are located near the front end of the rear holder 50 and are arranged at a predetermined distance from each other in the width direction. One of the partial locking portions 54 is provided substantially in a widthwise center of the rear holder 50 and the other is provided at a position near an end part.

The partial locking portions 54 are projections projecting on the upper and lower surfaces of the rear holder 50. Note that the partial locking portions 54 projecting on the upper surface are referred to as first partial locking portions 54F and those projecting on the lower surface are referred to as second partial locking portions 54S.

As shown in FIG. 12, the rear end of the first partial locking portion 54F is formed into a substantially vertically upright first partial locking surface 55. Further, the front surface of the first partial locking portion 54F is formed into a first inclined surface 56 inclined gradually up toward the back from the front end.

As shown in FIG. 12, the second partial locking portion 54S includes a bulge 57 that bulges from the lower surface of the rear holder 50 while having a long shape in the front-back direction, and a claw 58 projects on a tip part of the bulge 57. The bulge 57 extends from the vicinity of the rear end of the rear holder 50 to the vicinity of the front end. The rear end of the claw 58 is formed into a substantially vertically upright second locking surface 59. The first and second partial locking surfaces 55, 59 are located substantially at the same position in the front-back direction. Further, a second inclined surface 61 inclined gradually down toward the back from the front end is formed on the front surface of the second partial locking portion 54S. The second inclined surface 61 has the same gradient as the first inclined surface 56 and a longer dimension in the front-back direction than the first inclined surface 56.

The rear holder 50 includes the full locking portions 62 to be locked to the holder accommodating portion 28 when a transition is made from the partially locked state to the fully locked state. The full locking portions 62 contact the holder accommodating portion 28 to be resiliently deflected when the rear holder 50 transitions from the partially locked state to the fully locked state and are restored resiliently to be locked to the holder accommodating portion 28 when the rear holder 50 is set in the fully locked state.

As shown in FIG. 6, two full locking portions 62 are provided on each of opposite side surfaces of the rear holder 50. Each full locking portion 62 is a cantilever that can resiliently deflect in directions toward and away from the side surface of the rear holder 50. The full locking portion 62 includes a main body 63 extending forward from the rear end of the rear holder 50 and a claw 64 projecting outward from a tip part of the main body 63. The rear end of the claw 64 is formed into a substantially vertically upright full locking surface 65 and the front surface of the claw 64 is formed into a third inclined surface 66 inclined such that a projecting distance from the main body 63 gradually increases toward the back from the front end.

Parts of the side surfaces of the rear holder 50 facing the full locking portions 62 are slightly recessed from other parts, thereby forming escaping portions 67. Spaces between the escaping portions 67 and the full locking portions 62 serve as deformation spaces 68 for the full locking portions 62 (see FIG. 6).

Projecting portions 69 project from the side surface of the rear holder 50 between the pair of full locking portions 62 and at outer sides of the full locking portions 62, as shown in FIG. 6. The projecting portion 69 provided between the full locking portions 62 (hereinafter, referred to as an inner projecting portion 69U) is a substantially rectangular block and the projecting portions 69 provided at the outer sides (hereinafter, referred to as outer projecting portions 69S) have a triangular cross-sectional shape long and narrow in the vertical direction when viewed in the front-back direction.

Figure 7:
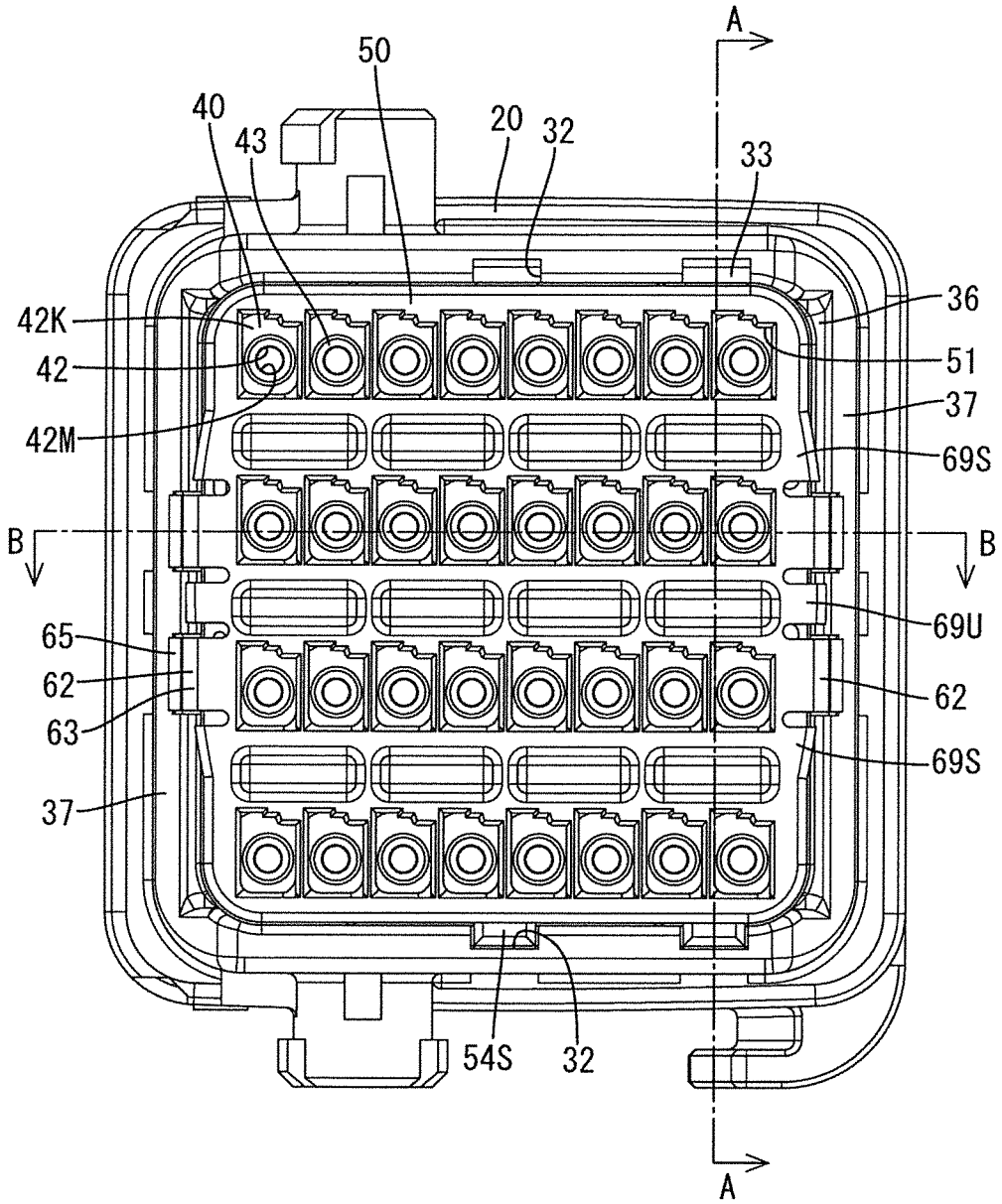
FIG. 7 is a rear view of the housing with the rear holder in a partially locked state.

As shown in FIG. 7, a side surface of the outer projecting portion 69S is inclined so that a projecting distance gradually decreases with distance from the full locking portion 62. A projecting distance of the outer projecting portions 69S is slightly shorter than that of the inner projecting portion 69U. Further, the upper outer projecting portion 69S has a larger vertical dimension than the lower outer projecting portion 69S.

Figure 21:
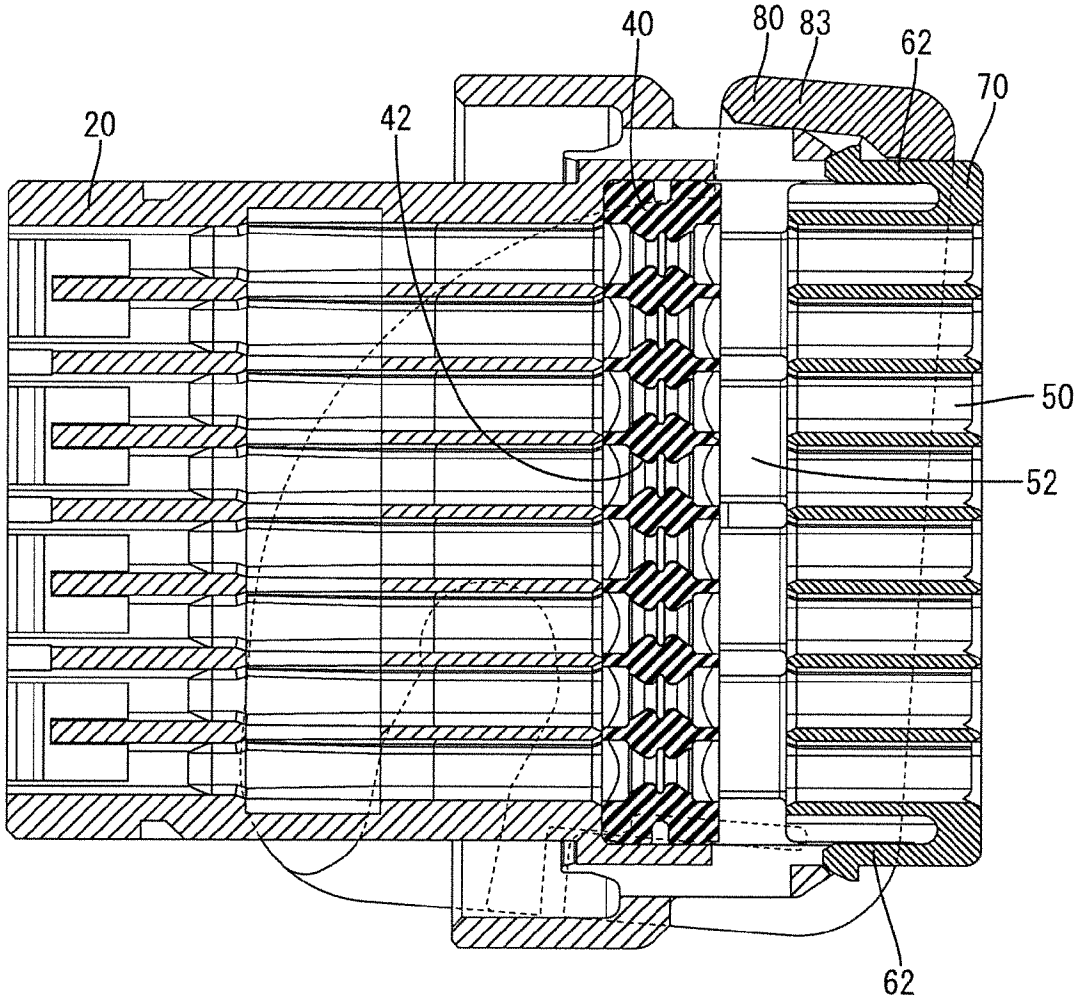
FIG. 21 is a cross-section along C-C of FIG. 18, showing that rotation of the lever is limited when the rear holder is in the partially locked state.

The rear holder 50 includes movement limiting portions 70 that are retracted from a rotational range of the lever 80 to permit the rotation of the lever 80 when the rear holder 50 is in the fully locked state (see FIG. 19) and located in the rotational range of the lever 80 to limit the rotation of the lever 80 when the rear holder 50 is in the partially locked state (see FIG. 21). The movement limiting portions 70 are most laterally projecting parts (rear end parts of the full locking portions 62) out of corner parts of the rear end of the rear holder 50.

Figure 10:
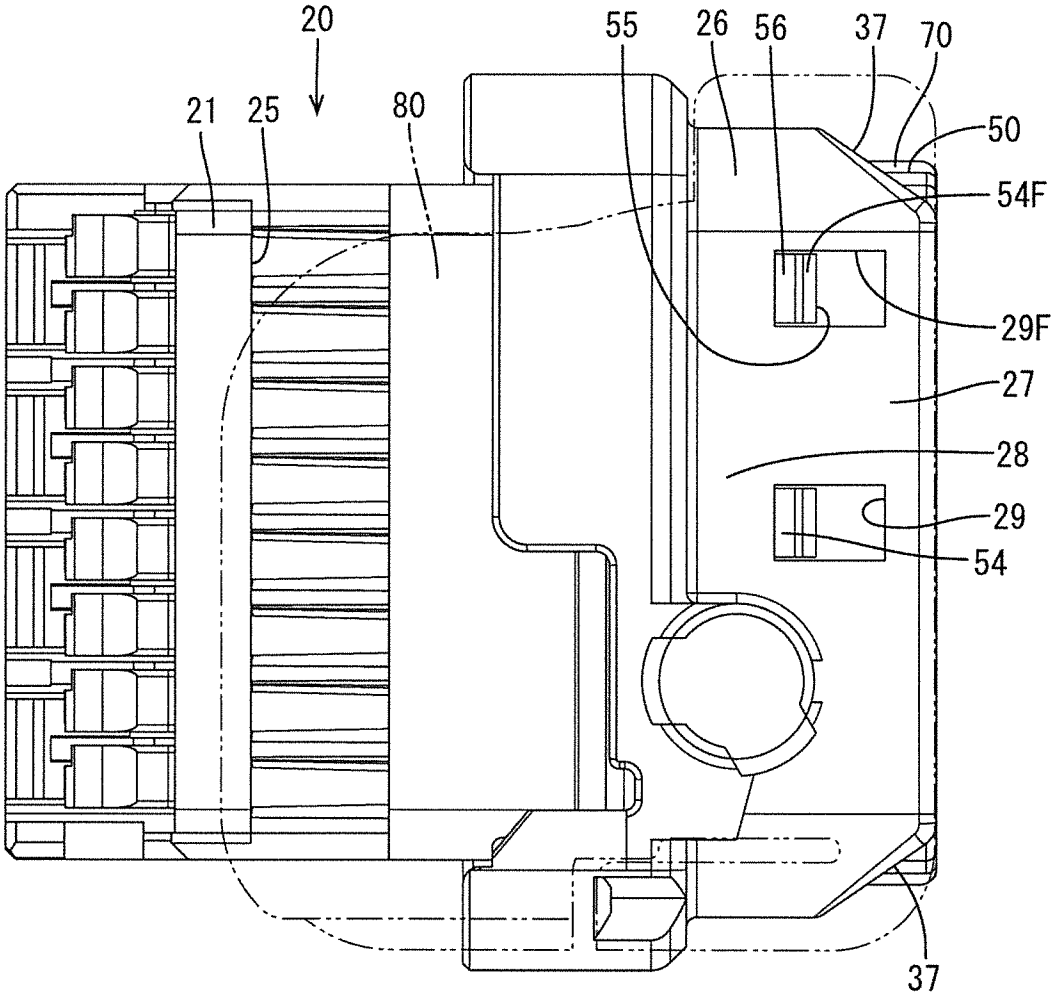
FIG. 10 is a plan view of the housing with the rear holder in a fully locked state.

When the rear holder 50 is in the fully locked state, the movement limiting portions 70 are accommodated in the holder accommodating portion 28, specifically located inwardly of the side surfaces of the holder accommodating portion 28 and forwardly of the rear surface as shown in FIG. 10. When the lever 80 is rotated from the connection position to the initial position, the lever 80 is rotated without coming into contact with the movement limiting portions 70.

On the other hand, when the rear holder 50 is in the partially locked state, the movement limiting portions 70 project backward from the holder accommodating portion 28 as shown in FIG. 8. When the lever 80 is rotated from the connection position to the initial position, the lever 80 comes into contact with the movement limiting portions 70 to limit any further rotation.

The connector 10 may be assembled by initially accommodating the one-piece rubber plug 40 into the rubber plug accommodating portion 27 of the housing 20. The one-piece rubber plug 40 is pushed into the rubber plug accommodating portion 27 from behind and is in a non-compressed state (state free from resilient deformation). At this time, the lever 80 is mounted at the connection position in advance.

The rear holder 50 then is mounted in the partially locked state. The rear holder 50 is pushed forward after being lightly fit into the rear end part of the holder accommodating portion 28. Then, as shown in FIG. 12, the first partial locking portions 54F located in the partial locking recesses 32 move forward while slightly pushing and widening the wall thereabove and eventually reach the first partial locked portions 29F, whereby the first partial locking surfaces 55 are locked to the first partial locked portions 29F. At this time, the first inclined surfaces 56 of the first partial locking portions 54F come into contact with the tapered surfaces 33 of the partial locking recesses 32 and are guided by the inclination thereof. Thus, the first partial locking portions 54F move relatively smoothly over rear parts of the first partial locked portions 29F.

Further, front end parts of the claw portions 58 of the second partial locking portions 54S located in the partial locking recesses 32 move forward while slightly pushing and widening the wall therebelow and the claw portions 58 eventually reach the second partial locked portions 29S. Thus, the second partial locking surfaces 59 are locked to the second partial locked portions 29S. At this time, the second partial locking portions 54S move relatively smoothly over rear parts of the second partial locked portions 29S since the second inclined surfaces 61 contact with the wall at an outer side of the partial locking recesses 32.

In this way, the first and second partial locking portions 54F, 54S are locked respectively to the first and second partial locked portions 29F, 29S and the rear holder 50 is mounted and held in the partially locked state on the housing 20. At this time, as shown in FIGS. 8 and 9, the rear end part of the rear holder 50 projects back from the holder accommodating portion 28 and the full locking portions 62 are located behind the holder accommodating portion 28.

Tip parts of the projections 52 of the rear holder 50 stay in the guiding portions 45 of the recesses 44 of the one-piece rubber plug 40 and neither push nor widen the recesses 44 when the rear holder 50 is in the partially locked state, as shown in FIG. 12. Accordingly, when the rear holder 50 is in the partially locked state, the one-piece rubber plug 40 is not deformed resiliently by the rear holder 40 and the insertion holes 42 of the one-piece rubber plug 40 are not vertically or laterally displaced from the cavities 22 of the terminal accommodating portion 21 and the receiving holes 51 of the rear holder 50. Thus, the shape of one-piece rubber plug 40 is maintained without being deformed.

Subsequently, the terminal fittings 12 are accommodated into the terminal accommodating portion 21 of the housing 20. The terminal fitting 12 fixed to the end of the wire 11 is inserted into the cavity 22 of the terminal accommodating portion 21 successively through the receiving hole 51 of the rear holder 50 and the insertion hole 42 of the one-piece rubber plug 40. At this time, since the receiving hole 51, the insertion hole 42 and the cavity 22 are concentrically aligned and the insertion hole 42 is not deformed to reduce its diameter, the terminal fitting 12 can be smoothly inserted. The terminal fitting 12 inserted up to a proper position in the cavity 22 is retained by the resin locking lance 23 and the inner peripheral lips 43 of the insertion hole 42 are resiliently held in close contact with the outer periphery of the wire 11, thereby sealing a clearance between the insertion hole 42 and the wire 11 in a watertight state.

The rear holder 50 in the partially locked state is set in the fully locked state after the inserting operation is completed for all the terminal fittings 12. When the rear holder 50 in the partially locked state is pushed forward, the full locking portions 62 contact the walls at the outer sides of the full locking recesses 34 and resiliently deflect inward. The claw portions 64 move over the walls at the outer sides of the full locking recesses 34 to restore resiliently and lock to the full locked portions 31 when the rear holder 50 is set in the fully locked state. At this time, the third inclined surfaces 66 of the full locking portions 62 contact the tapered surfaces 35 of the full locking recesses 34 and are guided by the inclination thereof so that the full locking portions 62 can easily move over the walls at the outer sides of the full locking recesses 34.

Figure 11:
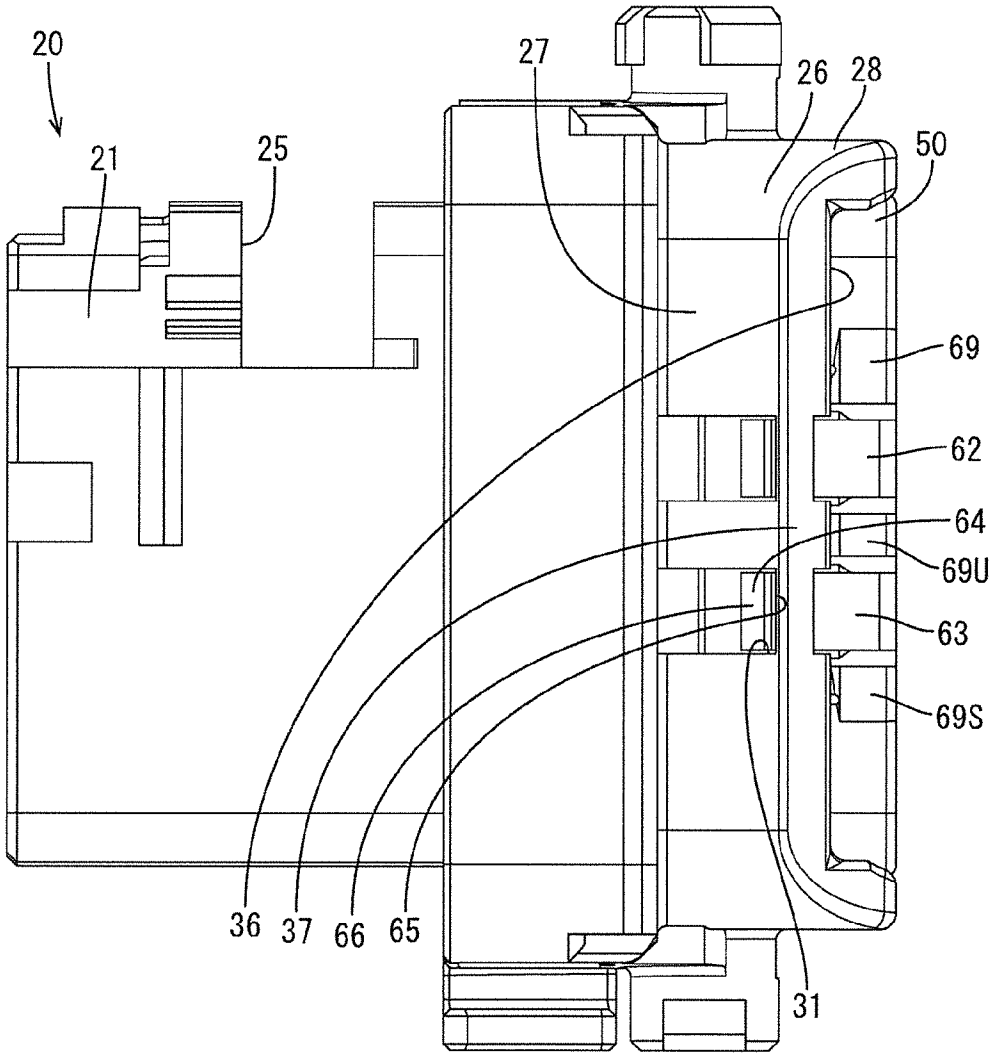
FIG. 11 is a side view of the housing with the rear holder in the fully locked state.

In this way, the full locking portions 62 are locked to the full locked portions 31 and the rear holder 50 is mounted and held in the fully locked state on the housing 20. At this time, as shown in FIGS. 10 and 11, the rear end of the rear holder 50 does not project from the rear end of the holder accommodating portion 28 and is aligned therewith in the front-back direction. Note that the partial locking portions 54 move forward in the partial locked portions 29 and reach the front ends of the partial locked portions 29.

The projections 52 of the rear holder 50 start entering the recesses 44 of the one-piece rubber plug 40 when the rear holder 50 is pushed forward from the partially locked state. The projections 52 of the rear holder 50 then are fit into the recesses 44 in and squeeze the pressed lips 46 of the recesses 44 while vertically and laterally pushing and widening the recesses 44. In this way, the inner peripheral lips 43 of the insertion holes 42 are pressed inward to be held more strongly in close contact with the wires 11 and the outer peripheral lips 41 of the one-piece rubber plug 40 are held more strongly in close contact with the sealing surface 27A of the one-piece rubber plug 27. Thus, when the rear holder 50 is in the fully locked state, the one-piece rubber plug 40 is deformed resiliently by the rear holder 50 so that the inner peripheral lips 43 are held strongly in close contact with the wires 11 and the outer peripheral lips 41 are held strongly in close contact with the rubber plug accommodating portion 27 to ensure a high sealing performance.

Figure 22:
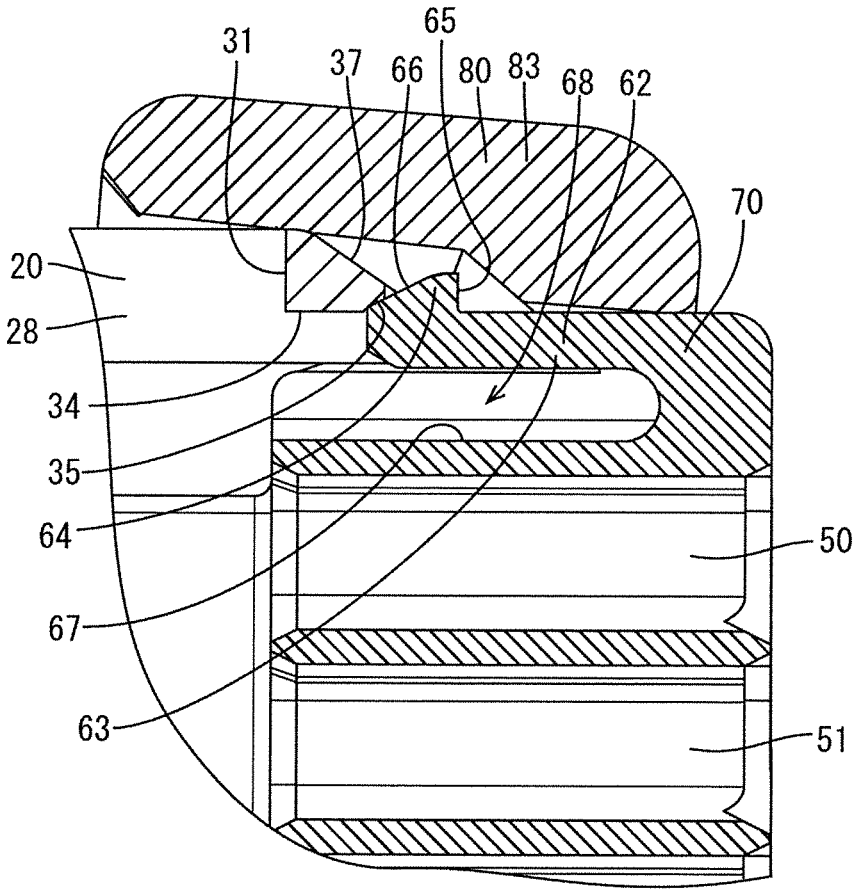
FIG. 22 is a partial enlarged view of FIG. 21 showing a state where the lever is in contact with the movement limiting portions.

Subsequently, the lever 80 is returned from the connection position to the initial position. Here, it may be forgotten to set the rear holder 50 in the fully locked state and the rear holder 50 may be still left in the partially locked state. In such a case, an operator can notice that the rear holder 50 is not in the fully locked state when seeing that the rear end of the rear holder 50 projects back from the holder accommodating portion 28, as shown in FIGS. 8 and 9. Further, even if the operator overlooks this state, the operating portion 83 of the lever 80 contacts the movement limiting portions 70 to limit any further rotation, as shown in FIGS. 21 and 22, when it is attempted to rotate the lever 80 from the connection position to the initial position. In this way, the operator can notice that the rear holder 50 is still left in the partially locked state.

Figure 19:
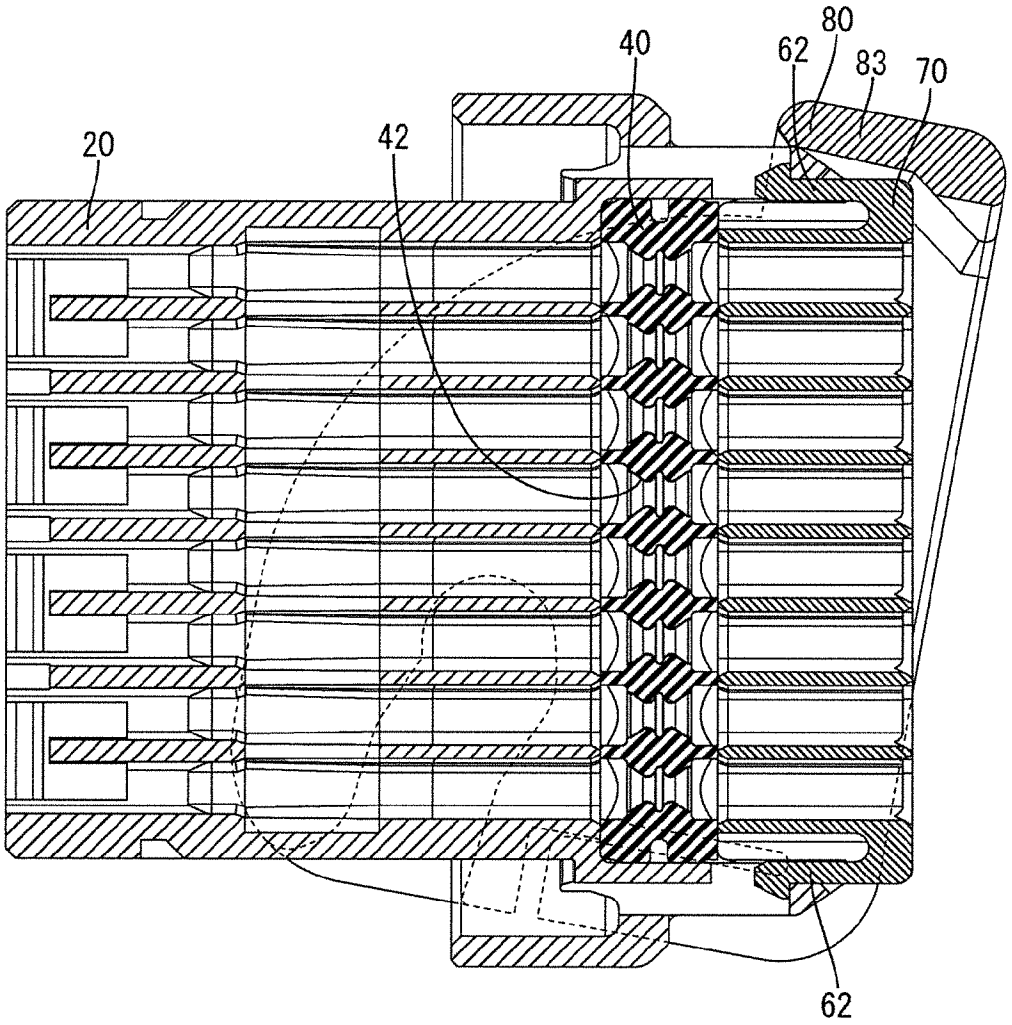
FIG. 19 is a cross-section taken along C-C of FIG. 18 showing that rotation of the lever is not limited when the rear holder is in the fully locked state.
Figure 20:
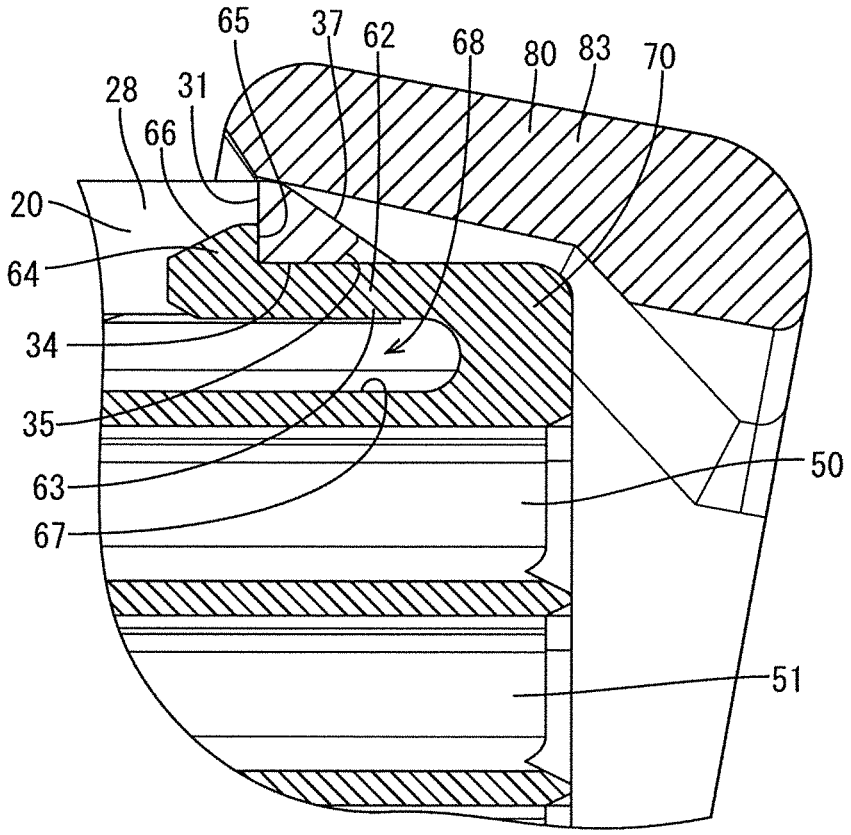
FIG. 20 is a partial enlarged view of FIG. 19 showing a state where the lever is not in contact with movement limiting portions.

The rear holder 50 is reliably set in the fully locked state by the operator noticing that the rear holder 50 is still in the partially locked state, as just described. After the rear holder 50 is set in the fully locked state in this way, the lever 80 is rotated and returned from the connection position to the initial position, as shown in FIGS. 19 and 20. Thus, an assembling operation of the connector 10 is completed.

As described above, the connector 10 of this embodiment is a waterproof connector including the housing 20 in which the terminal fittings 12 fixed to the ends of the wires 11 are accommodated. The one-piece rubber plug 40 is fit into the rear end side of the housing 20 to seal the interior of the housing 20. The rear holder 50 is mounted behind the one-piece rubber plug 40 in the partially locked state when inserting the terminal fittings 12 into the housing 20 and is set in the fully locked state when the terminal fittings 12 are completely accommodated. The lever 80 is assembled with the housing 20 and is rotated to assist a connecting operation to the mating connector 90. The movement limiting portions 70 are provided on the rear holder 50, retracted from the rotational range of the lever 80 to permit the rotation of the lever 80 when the rear holder 50 is in the full locking portion, but located in the rotational range of the lever 80 to limit the rotation of the lever 80 when the rear holder 50 is in the partially locked state. An inability to rotate the lever 80 notifies the operator that the rear holder 50 is in the partially locked state. Thus, the rear holder 50 can be moved to the fully locked state.

The rear holder 50 does not project from the rear end of the housing 20 when in the fully locked state and projects from the rear end of the housing 20 when in the partially locked state. Thus, whether the rear holder 50 is in the fully locked state or in the partially locked state easily is distinguished visually so that the rear holder 50 can be set more reliably in the fully locked state.

The one-piece rubber plug 40 is formed with the insertion holes 42 that enable the terminal fittings 12 to be inserted into the housing 20 and the recesses 44 are formed at sides of the insertion holes 42 on the one-piece rubber plug 40. The rear holder 50 includes the projections 52 to be fit into the recesses 44 as the rear holder 50 transitions from the partially locked state to the fully locked state. The projections 52 press the insertion holes 42 in the diameter reducing direction by being fit in a manner to resiliently push and widen the recesses 44.

When the rear holder 50 is set in the fully locked state in this way after the terminal fittings 12 are inserted into the insertion holes 42 of the one-piece rubber plug 40, the insertion holes 42 are held more strongly in close contact with the wires 11 to enhance adhesion. Thus, a high sealing performance can be ensured without deteriorating operability in inserting the terminal fittings 12 into the insertion holes 42 of the one-piece rubber plug 40.

Further, the rear holder 50 includes the full locking portions 62 to be locked to the housing 20 when a transition is made from the partially locked state to the fully locked state, and the full locking portions 62 come into contact with the housing 20 to be resiliently deflected during that transition and are restored resiliently to be locked to the housing 20 when the rear holder 50 is set in the fully locked state.

In this way, a force required for a transition of the rear holder 50 from the partially locked state to the fully locked state can be reduced as compared with the case where the full locking portions 62 provided on the rear holder 50 are locked to the housing such as by press-fitting. As a result, the rear holder 50 can relatively easily transition to the fully locked state. Note that, when the rear holder 50 transitions from the partially locked state to the fully locked state, the terminal fittings 12 are already in the housing 20, the wires 11 are drawn out from the rear surface of the rear holder 50 and a space for placing fingers in pushing the rear holder 50 is small. Thus, it is particularly effective to reduce the force required to push the rear holder 50 in this way.

The invention is not limited to the above described and illustrated embodiment. For example, the following embodiments are also included in the technical scope of the present invention.

Although the present invention is applied to the connector 10 of the type that the lever 80 is rotated in the above embodiment, there is no limitation to this. For example, the present invention can be applied also to a connector of a type that a lever is slid.

In the above embodiment, the movement limiting portions 70 are the corner parts of the rear end of the rear holder 50 and the operating portion 83 of the lever 80 comes into contact with the movement limiting portions 70 to limit any further rotation when the rear holder 50 is in the partially locked state. However, there is no limitation to this. A contact part of the rear holder with the lever may be any part. For example, separate projecting parts provided on the rear holder of the above embodiment may serve as movement limiting portions and, instead of the operating portion of the lever, the cam plates may come into contact with the movement limiting portions.

Although the lever 80 is mounted at the connection position in advance in accommodating the one-piece rubber plug 40 into the rubber plug accommodating portion 27 of the housing 20 in the above embodiment, there is no limitation to this. For example, in accommodating the one-piece rubber plug into the rubber plug accommodating portion of the housing, the lever may be mounted at the initial position in advance and, in such a case, the operating portion of the lever may come into contact with the movement limiting portions of the rear holder in rotating the lever from the initial position to the connection position.

Although the present invention is applied to such a connector 10 that sealing performance is improved by fitting the projections 52 provided on the rear holder 50 into the recesses 44 of the one-piece rubber plug 40 in the above embodiment, there is no limitation to this and the present invention can be applied to connectors with rear holders having various shapes.

Although the rear holder 50 does not project from the rear end of the housing 20 when being in the fully locked state and projects from the rear end of the housing 20 when being in the partially locked state in the above embodiment, there is no limitation to this and the rear holder may not project from the rear end of the housing both in the fully locked state and in the partially locked state or may project toward an opposite side.

Although the full locking portions 62 come into contact with the holder accommodating portion 28 to be resiliently deformed when the rear holder 50 transitions from the partially locked state to the fully locked state and are resiliently restored to be locked to the holder accommodating portion 28 when the rear holder 50 is set in the fully locked state in the above embodiment, there is no limitation to this and any locking structure may be employed for the full locking portions.

Although the full locking portions 62 are locked to the full locked portions 31 after being resiliently deformed when the rear holder 50 transitions from the partially locked state to the fully locked state in the above embodiment, there is no limitation to this. For example, the full locked portions may be resiliently deformed.

LIST OF REFERENCE SIGNS

10 . . . connector (waterproof connector)
11 . . . wire
12 . . . terminal fitting
20 . . . housing
40 . . . one-piece rubber plug (rubber plug)
42 . . . insertion hole
44 . . . recess
50 . . . rear holder
52 . . . projection
62 . . . full locking portion
70 . . . movement limiting portion
80 . . . lever
90 . . . mating connector

What is claimed is:

1. A waterproof connector, comprising:

a housing having an interior;

a terminal fitting fixed to an end of a wire and accommodated in the interior of the housing;

a rubber plug fit in a rear end of the housing to seal the interior of the housing;

a rear holder mounted behind the rubber plug, the rear holder being set in a partially locked state while inserting the terminal fitting into the housing and being set in a fully locked state when the terminal fitting is accommodated completely;

a lever assembled with the housing and being movable to assist a connecting operation to a mating connector; and a movement limiting portion provided on the rear holder, the movement limiting portion being retracted from a movable range of the lever to permit a movement of the lever when the rear holder is in the fully locked state and being in the movable range of the lever to limit the movement of the lever when the rear holder is in the partially locked state.

2. The waterproof connector of claim 1, wherein the rear holder does not project from the rear end of the housing when being in the fully locked state and projects from the rear end of the housing when being in the partially locked state.

3. The waterproof connector of claim 1, wherein:

the rubber plug is formed with an insertion hole that enables the terminal fitting to be inserted into the housing;

a recess recessed forward in the rubber plug at a side of the insertion hole;

the rear holder includes a projection to be fit into the recess as the rear holder transitions from the partially locked state to the fully locked state; and the projection presses the insertion hole in a diameter reducing direction by being fit into the recess in such a manner as to resiliently push and widen the recess.

4. The waterproof connector of claim 1, wherein:

the rear holder includes a full locking portion to be locked to the housing when a transition is made from the partially locked state to the fully locked state; and the full locking portion comes into contact with the housing to be resiliently deflected during the transition and is resiliently restored to be locked to the housing when the rear holder is set in the fully locked state.

* * * * *